US011036153B2

(12) United States Patent
Ishizuka et al.

(10) Patent No.: US 11,036,153 B2
(45) Date of Patent: Jun. 15, 2021

(54) TONER SET, TONER CARTRIDGE SET, AND APPARATUS FOR FORMING PRINTED MATERIAL

(71) Applicant: FUJIFILM Business Innovation Corp., Tokyo (JP)

(72) Inventors: Takahiro Ishizuka, Kanagawa (JP); Yasunobu Kashima, Kanagawa (JP); Hajime Sugahara, Kanagawa (JP); Susumu Yoshino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/742,106

(22) Filed: Jan. 14, 2020

(65) Prior Publication Data

US 2021/0018854 A1 Jan. 21, 2021

(30) Foreign Application Priority Data

Jul. 17, 2019 (JP) ..... JP2019-132141

(51) Int. Cl.

| | |
|---|---|
| ***G03G 9/08*** | (2006.01) |
| ***G03G 9/087*** | (2006.01) |
| ***G03G 15/20*** | (2006.01) |
| ***G03G 9/093*** | (2006.01) |
| ***G03G 9/09*** | (2006.01) |

(52) U.S. Cl.

CPC ..... *G03G 9/08711* (2013.01); *G03G 9/0821* (2013.01); *G03G 9/0926* (2013.01); *G03G 9/09321* (2013.01); *G03G 9/09364* (2013.01); *G03G 15/2021* (2013.01)

(58) Field of Classification Search

CPC . G03G 9/08711; G03G 9/0821; G03G 9/0926
USPC ..... 430/107.1, 111.4
See application file for complete search history.

(56) References Cited

U.S. PATENT DOCUMENTS

| | | | | |
|---|---|---|---|---|
| 9,223,261 | B2 | 12/2015 | Tamura et al. | |
| 2012/0251169 | A1* | 10/2012 | Aoki | G03G 15/0189 399/111 |
| 2019/0196363 | A1* | 6/2019 | Tanaka | G03G 21/1676 |

FOREIGN PATENT DOCUMENTS

| | | | |
|---|---|---|---|
| JP | 2008-155412 | A | 7/2008 |
| JP | 2008-173917 | A | 7/2008 |
| JP | 2013-015664 | A | 1/2013 |

* cited by examiner

*Primary Examiner* — Mark A Chapman
(74) *Attorney, Agent, or Firm* — Sughrue Mion, PLLC

(57) ABSTRACT

A toner set includes a color toner and a transparent toner that has a pressure phase transition property. The color toner and the transparent toner satisfy 1.0≤tan δ1≤4.0 and 1.2≤tan δ1/tan δ2≤3.0 where tan δ1 represents tan δ of the color toner at 100° C., and tan δ2 represents tan δ of the transparent toner at 100° C.

22 Claims, 3 Drawing Sheets

TONER SET, TONER CARTRIDGE SET, AND APPARATUS FOR FORMING PRINTED MATERIAL

CROSS-REFERENCE TO RELATED APPLICATIONS

This application is based on and claims priority under 35 USC 119 from Japanese Patent Application No. 2019-132141 filed Jul. 17, 2019.

BACKGROUND

(i) Technical Field

The present disclosure relates to a toner set, a toner cartridge set, and an apparatus for forming a printed material.

(ii) Related Art

Japanese Unexamined Patent Application Publication No. 2008-173917 describes an apparatus for producing a press-bonded sheet. This apparatus is used to bond sheets with powder toner particles serving as an adhesive, and fixing units for thermally fixing the adhesive to the sheets are provided at two places in this apparatus.

Japanese Unexamined Patent Application Publication No. 2008-155412 describes an apparatus for producing a half-fold press-bonded printed material ready for the post. This apparatus produces a press-bonded printed material by applying a powder adhesive to a sheet by electrophotographic transfer, and then press-bonding the secret information-printed surface of the sheet to which the powder adhesive has been applied. This apparatus is equipped with a first image forming unit that transfers secret information to a back surface of the sheet by using a toner, a second image forming unit that transfers a powder adhesive to the secret information transfer surface, a first heating and pressurizing device that fixes the secret information to the sheet and temporarily fixes the powder adhesive to the sheet, a conveying mechanism that flips and conveys the sheet, a third image forming unit that transfers modifiable information onto a front surface of the sheet, a second heating and pressurizing device that fixes the modifiable information to the front surface of the sheet, a first folding device that forms a valley fold at the middle of the back surface of the sheet, and a third heating and pressurizing device that applies heat and pressure to the powder adhesive temporarily fixed surface so as to perform press bonding.

Japanese Unexamined Patent Application Publication No. 2013-015664 describes an image forming apparatus equipped with: more than one image forming sections each including an image carrier, a developing unit, a transfer unit, and an image carrier cleaning unit; and a fixing unit. According to this apparatus, the toner used in the developing unit is a pressure phase transition resin toner that contains a pressure phase transition resin or a thermoplastic resin toner that contains a thermoplastic resin; the pressure phase transition resin toner or the thermoplastic resin toner is used in at least one developing unit of the image forming section; and there are separately provided a pressure fixing nip portion where a fixing nip of a fixing unit that fixes, onto a recording medium, the pressure phase transition resin toner that forms a toner image transferred onto the recording medium is formed and a thermal fixing nip portion where a fixing nip of a fixing unit that fixes, onto the recording medium, the thermoplastic resin toner that forms the toner image transferred onto the recording medium is formed. Moreover, the temperature Tb and the pressure Pb at which the pressure phase transition resin toner is fixed at the pressure fixing nip portion and the temperature Ta and the pressure Pa at which the thermoplastic resin toner is fixed at the thermal fixing nip portion satisfy the magnitude relationships Tb<Ta and Pb> Pa.

SUMMARY

Aspects of non-limiting embodiments of the present disclosure relate to a toner set that achieves both suppression of offset during thermal fixing and press bondability compared to when tan δ1 is less than 1.0 or more than 4.0 or when tan δ1/tan δ2 is less than 1.2 or more than 3.0.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided toner set includes a color toner and a transparent toner that has a pressure phase transition property. The color toner and the transparent toner satisfy $1.0 \leq \tan \delta 1 \leq 4.0$ and $1.2 \leq \tan \delta 1/\tan \delta 2 \leq 3.0$ where tan δ1 represents tan δ of the color toner at 100° C., and tan δ2 represents tan δ of the transparent toner at 100° C.

BRIEF DESCRIPTION OF THE DRAWINGS

Exemplary embodiments of the present disclosure will be described in detail based on the following figures, wherein.

DETAILED DESCRIPTION

Figure 1:
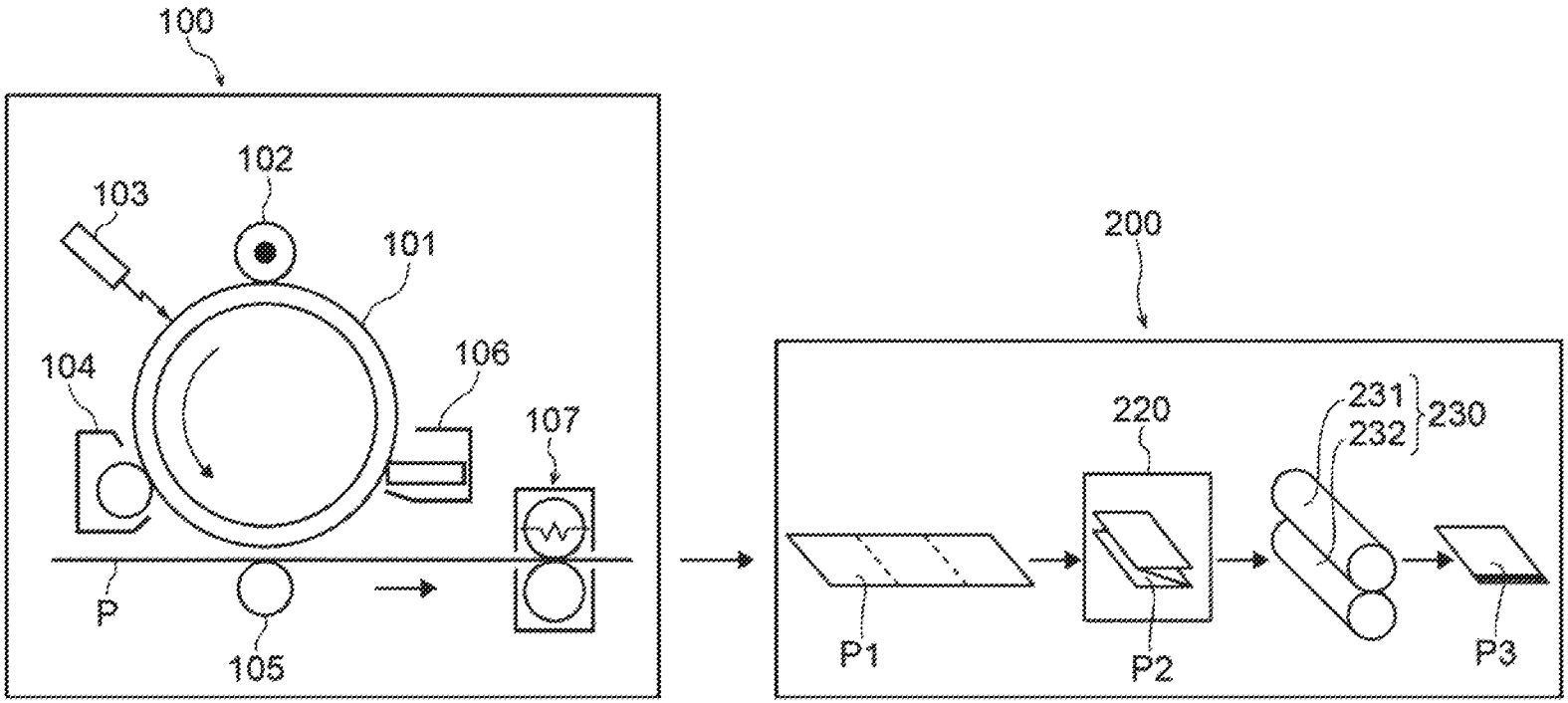
FIG. 1 is a schematic diagram illustrating one part of one example of an apparatus for producing a printed material according to an exemplary embodiment, the part including a placing unit and a press bonding unit.

Exemplary embodiments of the present disclosure will now be described. The following descriptions and examples are merely exemplary embodiments and do not limit the scopes of the exemplary embodiments.

In the present disclosure, the numerical range that uses "to" indicates an inclusive range in which the values preceding and following the word "to" are included as the minimum value and the maximum value, respectively, of the range.

When numerical ranges are described stepwise in the present disclosure, the upper limit or the lower limit of one numerical range may be substituted with an upper limit or a lower limit of a different numerical range also described stepwise. In the numerical ranges described in the present disclosure, the upper limit or the lower limit of one numerical range may be substituted with a value indicated in Examples.

In the present disclosure, when a drawing is referred to describe an exemplary embodiment, the structure of that exemplary embodiment is not limited to the structure illustrated in the drawing. Moreover, the size of a member in each drawing is schematic, and the relative size relationship between the members is not limited to what is illustrated.

In the present disclosure, each component may contain more than one corresponding substances. In the present disclosure, when the amount of a component in a composition is referred and when there are two or more substances that correspond to that component in the composition, the amount is the total amount of the two or more substances in the composition unless otherwise noted.

In the present disclosure, particles corresponding to each component may contain more than one type of particles. When there are more than one type of particles corresponding to one component in the composition, the particle diameter of each component is a particle diameter of a mixture of the more than one type of particles present in the composition unless otherwise noted.

In the present disclosure, the notation "(meth)acryl" means "acryl" or "methacryl".

In the present disclosure, color toners and a transparent toner may be collectively referred to as a "toner", and an "electrostatic charge image developer" may be simply referred to as a "developer".

In the present disclosure, a printed material formed by folding a recording medium and bonding opposing surfaces of flaps or a printed material formed by placing two or more recording media on top of each other and bonding opposing surfaces thereof is referred to as a "press-bonded printed material".

Toner Set

A toner set according to an exemplary embodiment includes a color toner and a transparent toner that has a pressure phase transition property. When tan δ of the color toner at 100° C. is represented by tan δ1 and tan δ of the transparent toner at 100° C. is represented by tan δ2, tan δ1 is 1.0 or more and 4.0 or less, and tan δ1 and tan δ2 satisfy formula 1 below:

$$1.2 \leq \tan \delta 1/\tan \delta 2 \leq 3.0 \quad \text{formula 1:}$$

Here, tan δ of the toner at 100° C. is determined as follows.

Specifically, tan δ is determined from a dynamic viscoelasticity measured by a sine wave oscillation method. The dynamic viscoelasticity is measured with ARES rheometer produced by Rheometric Scientific. The dynamic viscoelasticity is measured by forming the toner into a tablet, placing the tablet between parallel plates having a diameter of 8 mm, setting the normal force to 0, and then applying sine wave oscillations at an oscillation frequency of 6.28 rad/sec. The measurement is started from 20° C. and continued up to 120° C. at a temperature elevation rate of 1° C./min. The measurement time interval during this process is 30 seconds.

The term "color toner" means a toner that contains more than 1.0 mass % of a coloring agent in toner particles relative to the total amount of the toner particles. The term "transparent toner" means a toner that contains no coloring agent or that contains 1.0 mass % or less of a coloring agent in toner particles relative to the total amount of the toner particles.

The term "toner having a pressure phase transition property" means a toner that satisfies formula 3 below:

$$10° \text{ C.} \leq T1 = T2 \quad \text{formula 3:}$$

In formula 3, T1 represents a temperature at which the viscosity is 10000 Pa·s at a pressure of 1 MPa, and T2 represents a temperature at which the viscosity is 10000 Pa·s at a pressure of 10 MPa. The method for determining T1 and T2 is described below.

A printed material is produced by using a toner set that includes a color toner and a transparent toner that has a pressure phase transition property. For example, after a transparent toner layer is formed on a recording medium on which a color toner image has been formed, a thermal fixing process and a press bonding process are performed.

In the thermal fixing process, for example, the recording medium or the like is heated while a fixing member is in contact with the transparent toner layer so that the transparent toner layer is immobilized while the color toner image is thermally fixed to the recording medium. In this thermal fixing process, at least part of the transparent toner layer contacting the fixing member (in some cases, at least part of the transparent toner layer and at least part of the color toner image) may migrate to the fixing member side. This phenomenon is known as an offset phenomenon.

However, according to the toner set of this exemplary embodiment, offset is suppressed during thermal fixing and press bondability is achieved since tan δ1 is within the aforementioned range and tan δ1 and tan δ2 satisfy formula 1 described above. The reason behind this is not exactly clear, but is presumably as follows.

First, since tan δ1 is in the aforementioned range, it becomes easier to obtain excellent fixability of the color toner image to a recording medium. Specifically, when tan δ1 is within the aforementioned range, the color toner image easily melts during thermal fixing compared to when tan δ1 is below the aforementioned range. Thus, thermal fixability to a recording medium is improved, and offset is suppressed. Moreover, when tan δ1 is within the aforementioned range, an excessive increase in the viscosity of the color toner image is suppressed compared to when tan δ1 is beyond the aforementioned range. Thus, offset is suppressed, and press bondability is improved.

When tan δ1 is within the aforementioned range and tan δ1/tan δ2 is within the aforementioned range, suppression of the offset during thermal fixing and press bondability can both be achieved. Specifically, when the value of tan δ1/tan δ2 is within the aforementioned range, the viscosity of the color toner is higher than that of the transparent toner layer compared to when the value is below the aforementioned range. Thus, the transparent toner layer tends to remain on the color toner image side, and migration of the transparent toner layer toward the fixing member (in other words, offset) is easily suppressed. In addition, when the value of tan δ1/tan δ2 is within the aforementioned range, degradation of the press bondability caused by excessively high viscosity of the transparent toner layer is suppressed compared to when the value is beyond the aforementioned range.

Presumably due to the above-described reasons, the toner set of this exemplary embodiment achieves both suppression of the offset during thermal fixing and the press bondability.

The method for controlling tan δ1 and tan δ2 so that they satisfy the aforementioned condition may be any, and examples thereof include a method involving adjusting the molecular weights of the toner particles contained in each toner, and a method involving adjusting the composition of the toner particles (for example, the ratio of a crystalline resin).

The toner set at least includes a color toner and a transparent toner that has a pressure phase transition property, and may further include, as needed, other toners (for example, a transparent toner that does not have a pressure phase transition property). Hereinafter, the transparent toner that has a pressure phase transition property may be simply referred to as the "transparent toner".

The color toner may be one or combination of two or more color toners, and the transparent toner may be one or combination of two or more transparent toners.

The respective toners constituting the toner set of the present exemplary embodiment are described below.

Transparent Toner

The transparent toner has a pressure phase transition property, as mentioned above.

The transparent toner that has a pressure phase transition property may be any toner that has tan δ2 satisfying formula 1 regarding the relationship with tan δ1 and that satisfies formula 3.

The transparent toner that has a pressure phase transition property may contain a vinyl-based resin. Here, a "vinyl-based resin" refers to a resin obtained by radical polymerization of a monomer having a vinyl group. Examples of the monomer having a vinyl group include monomers having a vinyl group, a (meth)acryloyl group, a vinyl ether group, a vinyl ester group, an allyl group, or the like.

A specific example of the transparent toner having a pressure phase transition property is a toner that has at least two glass transition temperatures, in which the difference between the lowest glass transition temperature and the highest glass transition temperature is 30° C. or more.

An example of the toner in which the difference between the lowest glass transition temperature and the highest glass transition temperature is 30° C. or more is a toner containing a binder resin that contains a styrene resin containing styrene and other vinyl monomers as polymerization components, and a (meth)acrylic acid ester resin that contains at least two (meth)acrylic acid esters as polymerization components, in which the mass ratio of the (meth)acrylic acid esters relative to the total of polymerization components is 90 mass % or more.

In the description below, unless otherwise noted, a "styrene resin" refers to a "styrene resin that contains styrene unit and other vinyl monomer unit", and a "(meth)acrylic acid ester resin" refers to a "(meth)acrylic acid ester resin that contains at least two (meth)acrylic acid ester monomer units, in which the mass ratio of the (meth)acrylic acid ester monomer units relative to the total of polymerization components is 90 mass % or more".

The toner containing a binder resin that contains a styrene resin and a (meth)acrylic acid ester resin easily undergoes pressure-induced phase transition and exhibits excellent bondability compared to a toner containing a homopolymer of a (meth)acrylic acid ester instead of the aforementioned (meth)acrylic acid ester resin. The mechanism behind this is presumably as follows.

Typically, a styrene resin and a (meth)acrylic acid ester resin have low compatibility to each other, and thus it is considered that these resins contained in the toner particles are in a phase separated state. When toner particles are under pressure, a (meth)acrylic acid ester resin having a relatively low glass transition temperature is fluidized first, and this fluidization affects the styrene resin, resulting in fluidization of the two resins. It is also considered that when the two resins in the toner particles solidify and form a resin layer as the pressure is decreased after the two resins have fluidized under pressure, a phase separated state is again formed due to their low compatibility.

It is assumed that a (meth)acrylic acid ester resin that contains at least two (meth)acrylic acid ester monomer units is easily fluidizable under pressure because there are at least two types of ester groups bonded to the main chain and thus the degree of molecular alignment in a solid state is low compared to a homopolymer of a (meth)acrylic acid ester. Moreover, it is assumed that when the mass ratio of the (meth)acrylic acid ester monomer units relative to the total of the polymerization components is 90 mass % or more, at least two types of ester groups are present at a high density; thus, the degree of molecular alignment in a solid state becomes lower, and thus the resin becomes easily fluidizable under pressure. Thus, it is assumed that the above-described toner is easily fluidizable under pressure, in other words, easily undergoes pressure-induced phase transition, compared to a toner in which the (meth)acrylic acid ester resin is a homopolymer of a (meth)acrylic acid ester.

In addition, it is assumed that a (meth)acrylic acid ester resin containing at least two (meth)acrylic acid ester monomer units, in which the mass ratio of the (meth)acrylic acid ester monomer units relative to the total of polymerization components is 90 mass % or more, has a low degree of molecular alignment during re-solidification, and, thus, a microphase separation occurs with a styrene resin. The finer the state of phase separation between the styrene resin and the (meth)acrylic acid ester resin, the higher the uniformity of the state of the bonding surface to an adherend, and the more excellent the bondability. Thus, it is assumed that the above-described toner has excellent bondability compared to a toner in which the (meth)acrylic acid ester resin is a homopolymer of a (meth)acrylic acid ester.

In the description below, the components, the structure, and the properties of a toner that contains a binder resin containing the styrene resin and the (meth)acrylic acid ester resin are described in detail. This toner is one example of the transparent toner.

The transparent toner contains at least toner particles, and an external additive, if needed.

Toner Particles

The toner particles at least contain a binder resin. The binder resin contains, for example, a styrene resin and a (meth)acrylic acid ester resin.

The toner particles may further contain a coloring agent, a releasing agent, and other additives.

The styrene resin content in the binder resin may be larger than the (meth)acrylic acid ester resin content from the viewpoint of maintaining the bondability. The styrene resin content relative to the total content of the styrene resin and the (meth)acrylic acid ester resin is preferably 55 mass % or more and 80 mass % or less, is more preferably 60 mass % or more and 75 mass % or less, and is yet more preferably 65 mass % or more and 70 mass % or less.

Styrene Resin

The toner particles contain, for example, a styrene resin that contains styrene monomer unit and other vinyl monomer unit.

From the viewpoint of suppressing fluidization of the toner in an unpressured state, the mass ratio of styrene monomer unit relative to the total of the polymerization components of the styrene resin is preferably 60 mass % or more, more preferably 70 mass % or more, and yet more preferably 75 mass % or more. From the viewpoint of forming a toner that easily undergoes pressure-induced phase transition, the mass ratio is preferably 95 mass % or less, more preferably 90 mass % or less, and yet more preferably 85 mass % or less.

Examples of the vinyl monomers other than styrene monomer constituting the styrene resin include styrene monomers other than styrene and acryl monomers.

Examples of the styrene-based monomers other than styrene include vinyl naphthalene; alkyl-substituted styrenes such as α-methylstyrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; aryl-substituted styrenes such as p-phenylstyrene; alkoxy-substituted styrenes such as p-methoxystyrene; halogen-substituted styrenes such as p-chlorostyrene, 3,4-dichlorostyrene, p-fluorostyrene, and 2,5-difluorostyrene; and nitro-substituted styrenes such as m-nitrostyrene, o-nitrostyrene, and p-nitrostyrene. These styrene monomers may be used alone or in combination.

The acryl monomer may be at least one acryl monomer selected from the group consisting of (meth)acrylic acid and (meth)acrylic acid esters. Examples of the (meth)acrylic acid esters include (meth)acrylic acid alkyl esters, (meth) acrylic acid carboxy-substituted alkyl esters, (meth)acrylic acid hydroxy-substituted alkyl esters, (meth)acrylic acid alkoxy-substituted alkyl esters, and di(meth)acrylic acid esters. These acryl-based monomers may be used alone or in combination.

Examples of the (meth)acrylic acid alkyl esters include methyl (meth)acrylate, ethyl (meth)acrylate, propyl (meth) acrylate, isopropyl (meth)acrylate, n-butyl (meth)acrylate, isobutyl (meth)acrylate, n-hexyl (meth) acrylate, 2-ethylhexyl (meth) acrylate, lauryl (meth)acrylate, stearyl (meth) acrylate, cyclohexyl (meth) acrylate, dicyclopentanyl (meth) acrylate, and isobornyl (meth) acrylate.

An example of the (meth)acrylic acid carboxy-substituted alkyl ester is 2-carboxylethyl (meth)acrylate.

Examples of the (meth)acrylic acid hydroxy-substituted alkyl esters include 2-hydroxyethyl (meth)acrylate, 2-hydroxypropyl (meth) acrylate, 3-hydroxypropyl (meth)acrylate, 2-hydroxybutyl (meth)acrylate, 3-hydroxybutyl (meth) acrylate, and 4-hydroxybutyl (meth) acrylate.

An example of the (meth)acrylic acid alkoxy-substituted alkyl ester is 2-methoxyethyl (meth)acrylate.

Examples of the di(meth)acrylic acid esters include ethylene glycol di(meth)acrylate, diethylene glycol di(meth) acrylate, triethylene glycol di(meth)acrylate, butanediol di(meth)acrylate, pentanediol di(meth)acrylate, hexanediol di(meth)acrylate, nonanediol di(meth)acrylate, and decanediol di(meth)acrylate.

Examples of the (meth)acrylic acid esters also include 2-(diethylamino)ethyl (meth)acrylate, benzyl (meth)acrylate, and methoxypolyethylene glycol (meth)acrylate.

Examples of the other vinyl monomers constituting the styrene resin include, in addition to the styrene monomers and acryl monomers, (meth)acrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as isoprene, butene, and butadiene.

From the viewpoint of forming a toner that easily undergoes pressure-induced phase transition, the styrene resin preferably contains a (meth)acrylic acid ester monomer unit, more preferably a (meth)acrylic acid alkyl ester monomer unit, yet more preferably a (meth)acrylic acid alkyl ester monomer unit in which the alkyl group contains 2 to 10 carbon atoms, still more preferably a (meth)acrylic acid alkyl ester monomer unit in which the alkyl group contains 4 to 8 carbon atoms, and particularly preferably at least one of n-butyl acrylate monomer unit and 2-ethylhexyl acrylate monomer unit. From the viewpoint of forming a toner that easily undergoes pressure-induced phase transition, the styrene resin and the (meth)acrylic acid ester resin may contain the same (meth)acrylic acid ester monomer unit.

From the viewpoint of suppressing fluidization of the toner in an unpressured state, the mass ratio of the (meth) acrylic acid ester monomer unit relative to the total of the polymerization components of the styrene resin is preferably 40 mass % or less, more preferably 30 mass % or less, and yet more preferably 25 mass % or less. From the viewpoint of forming a toner that easily undergoes pressure-induced phase transition, the mass ratio is preferably 5 mass % or more, more preferably 10 mass % or more, and yet more preferably 15 mass % or more. The (meth)acrylic acid ester monomer unit here is preferably a (meth)acrylic acid alkyl ester monomer unit, yet more preferably a (meth)acrylic acid alkyl ester monomer unit in which the alkyl group contains 2 to 10 carbon atoms, and still more preferably a (meth) acrylic acid alkyl ester monomer unit in which the alkyl group contains 4 to 8 carbon atoms.

The styrene resin particularly preferably contains at least one of n-butyl acrylate monomer unit and 2-ethylhexyl acrylate monomer unit, and the total amount of n-butyl acrylate monomer unit and 2-ethylhexyl acrylate monomer unit relative to the total of polymerization components of the styrene resin is preferably 40 mass % or less, more preferably 30 mass % or less, and yet more preferably 25 mass % or less from the viewpoint of suppressing fluidization of the toner in an unpressured state. From the viewpoint of forming a toner that easily undergoes pressure-induced phase transition, the total amount is preferably 5 mass % or more, more preferably 10 mass % or more, and yet more preferably 15 mass % or more.

From the viewpoint of suppressing fluidization of the toner in an unpressured state, the weight average molecular weight of the styrene resin is preferably 3000 or more, more preferably 4000 or more, and yet more preferably 5000 or more. From the viewpoint of forming a toner that easily undergoes pressure-induced phase transition, the weight average molecular weight is preferably 50000 or less, more preferably 45000 or less, and yet more preferably 40000 or less.

In the present disclosure, the weight average molecular weight of a resin is measured by gel permeation chromatography (GPC). The molecular weight measurement by GPC is conducted by using HLC-8120GPC produced by TOSOH CORPORATION as a GPC instrument with columns, TSKgel Super HM-M (15 cm) produced by TOSOH CORPORATION, and tetrahydrofuran as a solvent. The weight average molecular weight of a resin is calculated by using a molecular weight calibration curve prepared by using monodisperse polystyrene standard samples.

From the viewpoint of suppressing fluidization of the toner in an unpressured state, the glass transition temperature of the styrene resin is preferably 30° or more, more preferably 40° or more, and yet more preferably 50° or more. From the viewpoint of forming a toner that easily undergoes pressure-induced phase transition, the glass transition temperature is preferably 110° or less, more preferably 100° or less, and yet more preferably 90° or less.

In the present disclosure, the glass transition temperature of a resin is determined from a differential scanning calorimetry curve (DSC curve) obtained by performing differential scanning calorimetry (DSC). More specifically, the glass transition temperature is determined from the "extrapolated glass transition onset temperature" described in the method for determining the glass transition temperature in JIS K 7121:1987 "Testing Methods for Transition Temperatures of Plastics".

The glass transition temperature of a resin is controlled by the types of polymerization components and the polymerization ratios. The glass transition temperature has a tendency to decrease as the density of flexible units, such as a methylene group, an ethylene group, and an oxyethylene group, contained in the main chain increases, and has a tendency to increase as the density of rigid units, such as aromatic rings and cyclohexane rings, contained in the main chain increases. Moreover, the glass transition temperature has a tendency to decrease as the density of aliphatic groups in side chains increases.

From the viewpoint of suppressing fluidization of the toner in an unpressured state, the mass ratio of the styrene resin relative to the total amount of the toner particles of the transparent toner is preferably 55 mass % or more, more preferably 60 mass % or more, and yet more preferably 65 mass % or more. From the viewpoint of forming a toner that easily undergoes pressure-induced phase transition, the mass ratio is preferably 80 mass % or less, more preferably 75 mass % or less, and yet more preferably 70 mass % or less.

(Meth)acrylic acid ester resin

The toner particles contain, for example, a (meth)acrylic acid ester resin containing at least two (meth)acrylic acid ester monomer units, in which the mass ratio of the (meth) acrylic acid ester monomer units relative to the total of polymerization components is 90 mass % or more.

The mass ratio of the (meth)acrylic acid ester monomer units relative to the total of the polymerization components of the (meth)acrylic acid ester resin is, for example, 90 mass % or more, preferably 95 mass % or more, more preferably 98 mass % or more, and yet more preferably 100 mass %.

Examples of the (meth)acrylic acid ester monomers include (meth)acrylic acid alkyl esters, (meth)acrylic acid carboxy-substituted alkyl esters, (meth)acrylic acid hydroxy-substituted alkyl esters, (meth)acrylic acid alkoxy-substituted alkyl esters, and di(meth)acrylic acid esters.

Examples of the (meth)acrylic acid alkyl esters include methyl (meth)acrylate, ethyl (meth)acrylate, propyl (meth) acrylate, isopropyl (meth)acrylate, n-butyl (meth)acrylate, isobutyl (meth)acrylate, n-hexyl (meth) acrylate, 2-ethylhexyl (meth) acrylate, lauryl (meth)acrylate, stearyl (meth) acrylate, cyclohexyl (meth) acrylate, dicyclopentanyl (meth) acrylate, and isobornyl (meth) acrylate.

An example of the (meth)acrylic acid carboxy-substituted alkyl ester is 2-carboxylethyl (meth)acrylate.

Examples of the (meth)acrylic acid hydroxy-substituted alkyl esters include 2-hydroxyethyl (meth)acrylate, 2-hydroxypropyl (meth) acrylate, 3-hydroxypropyl (meth)acrylate, 2-hydroxybutyl (meth)acrylate, 3-hydroxybutyl (meth) acrylate, and 4-hydroxybutyl (meth) acrylate.

An example of the (meth)acrylic acid alkoxy-substituted alkyl ester is 2-methoxyethyl (meth)acrylate.

Examples of the di(meth)acrylic acid esters include ethylene glycol di(meth)acrylate, diethylene glycol di(meth) acrylate, triethylene glycol di(meth)acrylate, butanediol di(meth)acrylate, pentanediol di(meth)acrylate, hexanediol di(meth)acrylate, nonanediol di(meth)acrylate, and decanediol di(meth)acrylate.

Examples of the (meth)acrylic acid esters also include 2-(diethylamino)ethyl (meth)acrylate, benzyl (meth)acrylate, and methoxypolyethylene glycol (meth)acrylate.

These (meth)acrylic acid esters may be used alone or in combination.

From the viewpoint of forming a toner that easily undergoes pressure-induced phase transition and has excellent bondability, the (meth)acrylic acid esters are preferably (meth)acrylic acid alkyl esters, yet more preferably (meth) acrylic acid alkyl esters in which the alkyl group contains 2 to 10 carbon atoms, still more preferably (meth)acrylic acid alkyl esters in which the alkyl group contains 4 to 8 carbon atoms, and particularly preferably n-butyl acrylate and 2-ethylhexyl acrylate. From the viewpoint of forming a toner that easily undergoes pressure-induced phase transition, the styrene resin and the (meth)acrylic acid ester resin may contain the same (meth)acrylic acid ester monomer unit.

From the viewpoint of forming a toner that easily undergoes pressure-induced phase transition and has excellent bondability, the mass ratio of the (meth)acrylic acid alkyl ester monomer units relative to the total of the polymerization components of the (meth)acrylic acid ester resin is preferably 90 mass % or more, more preferably 95 mass % or more, yet more preferably 98 mass % or more, and still more preferably 100 mass %. The (meth)acrylic acid alkyl ester monomer units here preferably each have an alkyl group containing 2 to 10 carbon atoms and more preferably each have an alkyl group containing 4 to 8 carbon atoms.

From the viewpoint of forming a toner that easily undergoes pressure-induced phase transition and has excellent bondability, the mass ratio between two (meth)acrylic acid ester monomer units having the largest and second-largest mass ratios among the at least two (meth)acrylic acid ester monomer units contained as the polymerization components in the (meth)acrylic acid ester resin is preferably 80:20 to 20:80, more preferably 70:30 to 30:70, and yet more preferably 60:40 to 40:60.

The two (meth)acrylic acid ester monomer units having the largest and second-largest mass ratios among the at least two (meth)acrylic acid ester monomer units contained in the (meth)acrylic acid ester resin are preferably (meth)acrylic acid alkyl ester monomer units. The (meth)acrylic acid alkyl ester monomer units here preferably each have an alkyl group having 2 to 10 carbon atoms and more preferably each have an alkyl group containing 4 to 8 carbon atoms.

When the two (meth)acrylic acid ester monomer units having the largest and second-largest mass ratios among the at least two (meth)acrylic acid ester monomer units contained in the (meth)acrylic acid ester resin are (meth)acrylic acid alkyl ester monomer units, from the viewpoint of forming a toner that easily undergoes pressure-induced phase transition and has excellent bondability, the difference in the number of carbon atoms in the alkyl group between the two (meth)acrylic acid alkyl ester monomer units is preferably 1 to 4, more preferably 2 to 4, and yet more preferably 3 or 4.

From the viewpoint of forming a toner that easily undergoes pressure-induced phase transition and has excellent bondability, the (meth)acrylic acid ester resin preferably contains n-butyl acrylate monomer unit and 2-ethylhexyl acrylate monomer unit. In particular, the two (meth)acrylic acid ester monomer units having the largest and second-largest mass ratios among the at least two (meth)acrylic acid ester monomer units contained as the polymerization components in the (meth)acrylic acid ester resin are preferably n-butyl acrylate monomer unit and 2-ethylhexyl acrylate monomer unit. The total amount of n-butyl acrylate monomer unit and 2-ethylhexyl acrylate monomer unit relative to the total of the polymerization components of the (meth) acrylic acid ester resin is preferably 90 mass % or more, more preferably 95 mass % or more, yet more preferably 98 mass % or more, and still more preferably 100 mass %.

The (meth)acrylic acid ester resin may further contain vinyl monomer units other than (meth)acrylic acid ester monomer units. Examples of the vinyl monomers other than the (meth)acrylic acid esters include (meth)acrylic acid; styrene; styrene-based monomers other than styrene; (meth)

acrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as isoprene, butene, and butadiene. These vinyl monomers may be used alone or in combination.

When the (meth)acrylic acid ester resin contains a vinyl monomer unit other than (meth)acrylic acid ester monomer units, the vinyl monomer unit other than the (meth)acrylic acid ester units is preferably at least one of acrylic acid monomer unit and methacrylic acid monomer unit and is more preferably acrylic acid.

From the viewpoint of suppressing fluidization of the toner in an unpressured state, the weight average molecular weight of the (meth)acrylic acid ester resin is preferably 100,000 or more, more preferably 120,000 or more, and yet more preferably 150,000 or more. From the viewpoint of forming a toner that easily undergoes pressure-induced phase transition, the weight average molecular weight is preferably 250,000 or less, more preferably 220,000 or less, and yet more preferably 200,000 or less.

From the viewpoint of forming a toner that easily undergoes pressure-induced phase transition, the glass transition temperature of the (meth)acrylic acid ester resin is preferably 10° or less, more preferably 0° or less, and yet more preferably −10° or less. From the viewpoint of suppressing fluidization of the toner in an unpressured state, the glass transition temperature is preferably −90° or more, more preferably −80° or more, and yet more preferably −70° or more.

From the viewpoint of forming a toner that easily undergoes pressure-induced phase transition, the mass ratio of the (meth)acrylic acid ester resin relative to the total of the toner particles is preferably 20 mass % or more, more preferably 25 mass % or more, and yet more preferably 30 mass % or more. From the viewpoint of suppressing fluidization of the toner in an unpressured state, the mass ratio is preferably 45 mass % or less, more preferably 40 mass % or less, and yet more preferably 35 mass % or less.

The total amount of the styrene resin and the (meth) acrylic acid ester resin contained in the toner particles relative to the total of the toner particles is preferably 70 mass % or more, more preferably 80 mass % or more, yet more preferably 90 mass % or more, still preferably 95 mass % or more, and most preferably 100 mass %.

Other Resins

The toner particles may contain, for example, a non-vinyl-based resin such as epoxy resins, polyester resins, polyurethane resins, polyamide resins, cellulose resins, polyether resins, and modified rosin. These resins may be used alone or in combination.

Various Additives

The toner particles may contain, if needed, a coloring agent (for example, a pigment or a dye), a releasing agent (for example, hydrocarbon wax, natural wax such as carnauba wax, rice wax, or candelilla wax, a synthetic or mineral or petroleum wax such as montan wax; or ester wax such as fatty acid ester or montanic acid ester), a charge controlling agent, and the like.

However, the toner particles do not contain a coloring agent, or, the coloring agent content in the toner particles relative to the total of the toner particles is 1.0 mass % or less. From the viewpoint of increasing the transparency of the toner, the coloring agent content in the toner particles may be small.

Structure of Toner Particles

The inner structure of the toner particles may be a sea-island structure. The sea-island structure may be constituted by a sea phase containing a styrene resin and island-phases containing a (meth)acrylic acid ester resin dispersed in the sea phase. Specific examples of the styrene resin contained in the sea phase are as described above. Specific examples of the (meth)acrylic acid ester resin contained in the island phases are as described above. Alternatively, island phases not containing a (meth)acrylic acid ester resin may be dispersed in the sea phase.

When the toner particles have a sea-island structure, the average size of the island phases may be 200 nm or more and 500 nm or less. When the average size of the island phases is 500 nm or less, the toner particles easily undergoes pressure-induced phase transition. When the average size of the island phases is 200 nm or more, excellent mechanical strength desired for the toner particles (for example, the strength that withstands deformation during stirring in a developing device) is exhibited. From these viewpoints, the average size of the island phases is more preferably 220 nm or more and 450 nm or less and yet more preferably 250 nm or more and 400 nm or less.

Examples of the method for controlling the average size of the island phases of the sea-island structure to be within the aforementioned range include increasing or decreasing the amount of the (meth)acrylic acid ester resin relative to the amount of the styrene resin and increasing or decreasing the length of time of maintaining a high temperature in the process of fusing and coalescing aggregated particles in the method for producing toner particles described below.

The sea-island structure is confirmed and the average size of the island phases is measured as follows.

The toner is embedded in an epoxy resin, a section is prepared by using a diamond knife or the like, and the prepared section is stained with osmium tetroxide or ruthenium tetroxide in a desiccator. The stained section is observed with a scanning electron microscope (SEM). The sea phase and the island phases of the sea-island structure are distinguished by the shade created by the degree of staining with osmium tetroxide or ruthenium tetroxide, and the presence or absence of the sea-island structure is identified by the shade. From an SEM image, one hundred island phases are selected at random, a long axis of each island phase is measured, and the average of one hundred long axes is used as the average size.

The toner particles may be a single layer structure toner particles, or core-shell structure toner particles each constituted by a core and a shell layer coating the core. From the viewpoint of suppressing fluidization of the toner in an unpressured state, the toner particles may have a core-shell structure.

From the viewpoint of inducing the phase transition under pressure, when the toner particles have a core-shell structure, the core may contain a styrene resin and a (meth)acrylic acid ester resin. From the viewpoint of suppressing fluidization of the toner in an unpressured state, the shell layer may contain a styrene resin. The specific examples of the styrene resin are as described above. The specific examples of the (meth)acrylic acid ester resin are as described above.

When the toner particles have a core-shell structure, the core may have a sea phase containing a styrene resin and island phases containing a (meth)acrylic acid ester resin dispersed in the sea phase. The average size of the island phases may be within the aforementioned range. In addition to the core having the above-described structure, the shell layer may contain a styrene resin. In such a case, the sea phase of the core and the shell layer form a continuous structure, and the toner particles easily undergoes pressure-induced phase transition. The specific examples of the styrene resin contained in the sea phase of the core and the shell layer are as described above. The specific examples of the (meth)acrylic acid ester resin contained in the island phases of the core are as described above.

Examples of the resin contained in the shell layer also include polystyrene, non-vinyl-based resins such as epoxy resins, polyester resins, polyurethane resins, polyamide resins, cellulose resins polyether resins, and modified rosin. These resins may be used alone or in combination.

From the viewpoint of suppressing deformation of the toner particles, the average thickness of the shell layer is preferably 120 nm or more, more preferably 130 nm or more, and yet more preferably 140 nm or more. From the viewpoint of inducing the phase transition of the toner particles under pressure, the average thickness is preferably 550 nm or less, more preferably 500 nm or less, and yet more preferably 400 nm or less.

The average thickness of the shell layer is measured by the following method.

The toner is embedded in an epoxy resin, a section is prepared by using a diamond knife or the like, and the prepared section is stained with osmium tetroxide or ruthenium tetroxide in a desiccator. The stained section is observed with a scanning electron microscope (SEM). From an SEM image, ten toner particle sections are selected at random, the thickness of the shell layer is measured at twenty positions per toner particle, and the average thickness is calculated. The average value of ten toner particles is used as the average thickness.

From the viewpoint of ease of handling the toner particles, the volume average particle diameter (D50v) of the toner particles is preferably 4 μm or more, more preferably 5 μm or more, and yet more preferably 6 μm or more. From the viewpoint of inducing the phase transition of the entire toner particles under pressure, the volume-average particle diameter is preferably 15 μm or less, more preferably 12 μm or less, and yet more preferably 10 μm or less.

The volume average particle diameter (D50v) of the toner particles is determined by using a COULTER MULTISIZER II ((produced by Beckman Coulter Inc.) with apertures having an aperture diameter of 100 μm. Into 2 mL of a 5 mass % aqueous solution of sodium alkyl benzenesulfonate, 0.5 mg or more and 50 mg or less of toner particles are added and dispersed, and then the resulting dispersion is mixed with 100 mL or more and 150 mL or less of an electrolyte (ISOTON-II produced by Beckman Coulter Inc.). The resulting mixture is dispersed for 1 minute in an ultrasonic disperser, and the obtained dispersion is used as a sample. The particle diameters of 50000 particles having a particle diameter of 2 μm or more and 60 μm or less in the sample are measured. The particle diameter at 50% accumulation in a volume-based particle size distribution calculated from the small diameter side is used as the volume average particle diameter (D50v).

From the viewpoint of suppressing offset during thermal fixing, the weight average molecular weight of the toner particles is preferably 10000 or more, more preferably 20000 or more, and yet more preferably 50000 or more. From the viewpoint of achieving both suppression of offset during thermal fixing and the press bondability, the weight average molecular weight is preferably 250000 or less, more preferably 200000 or less, and yet more preferably 150000 or less.

From the viewpoint of suppressing offset during thermal fixing, the number average molecular weight of the toner particles is preferably 5000 or more, more preferably 8000 or more, and yet more preferably 10000 or more. From the viewpoint of achieving both suppression of offset during thermal fixing and the press bondability, the number average molecular weight is preferably 50000 or less, more preferably 40000 or less, and yet more preferably 30000 or less.

External Additive

An example of the external additive is inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as an external additive may be hydrophobized. Hydrophobizing involves, for example, immersing inorganic particles in a hydrophobizing agent. The hydrophobizing agent may be any, and examples thereof include silane coupling agents, silicone oils, titanate coupling agents, and aluminum coupling agents. These may be used alone or in combination. The amount of the hydrophobizing agent is, for example, 1 part by mass or more and 10 parts by mass or less relative to 100 parts by mass of the inorganic particles.

Other examples of the external additive include resin particles (resin particles of polystyrene, polymethyl methacrylate, melamine resin, etc.), and cleaning activating agents (for example, particles of metal salts of higher aliphatic acids such as zinc stearate and fluorine-based high-molecular-weight materials).

The externally added amount of the external additive is preferably 0.01 mass % or more and 5 mass % or less and is more preferably 0.01 mass % or more and 2.0 mass % or less relative to the toner particles.

Properties of transparent toner

Pressure Phase Transition Property

The transparent toner is a toner that undergoes pressure-induced phase transition and satisfies formula 3 below:

$$10° \text{ C.} \leq T1 - T2 \qquad \text{formula 3:}$$

In formula 3, T1 represents a temperature at which the viscosity is 10000 Pa·s at a pressure of 1 MPa, and T2 represents a temperature at which the viscosity is 10000 Pa·s at a pressure of 10 MPa.

From the viewpoint of inducing phase transition of the toner under pressure, the temperature difference (T1−T2) is preferably 10° C. or more, more preferably 15° C. or more, and yet more preferably 20° C. or more. From the viewpoint of suppressing fluidization of the toner in an unpressured state, the temperature difference (T1−T2) is preferably 120° C. or less, more preferably 100° C. or less, and yet more preferably 80° C. or less.

The value of the temperature T1 is preferably 140° C. or less, more preferably 130° C. or less, yet more preferably 120° C. or less, and still more preferably 115° C. or less.

The value of the temperature T2 is preferably 40° C. or more, more preferably 50° C. or more, and yet more preferably 60° C. or more. The upper limit of the temperature T2 may be 85° C. or less.

One indicator of how easily the toner undergoes pressure-induced phase transition is the temperature difference (T1−T3) between the temperature T1 at which the viscosity is 10000 Pa·s at a pressure of 1 MPa and the temperature T3 at which the viscosity is 10000 Pa·s at a pressure of 4 MPa. The temperature difference (T1−T3) may be 5° C. or more. From the viewpoint of inducing the phase transition under pressure, the transparent toner preferably has a temperature difference (T1−T3) of 5° C. or more and more preferably 10° C. or more.

The temperature difference (T1–T3) is typically 25° C. or less.

From the viewpoint of adjusting the temperature difference (T1–T3) to 5° C. or more, the temperature T3 at which the viscosity is 10000 Pa·s at a pressure of 4 MPa is preferably 90° C. or less, more preferably 85° C. or less, and yet more preferably 80° C. or less. The lower limit of the temperature T3 may be 60° C. or more.

The method for determining the temperature T1, the temperature T2, and the temperature T3 is as follows.

A toner is compressed into a pellet-shaped sample. The pellet-shaped sample is placed in a Flowtester (CFT-500 produced by Shimadzu Corporation), the applied pressure is fixed at 1 MPa, and the viscosity at 1 MPa relative to the temperature is measured. From the obtained viscosity graph, the temperature T1 at which the viscosity is $10^4$ Pa·s at an applied pressure of 1 MPa is determined. The temperature T2 is determined as with the method for determining the temperature T1 except that the applied pressure is changed from 1 MPa to 10 MPa. The temperature T3 is determined as with the method for determining the temperature T1 except that the applied pressure is changed from 1 MPa to 4 MPa. The temperature difference (T1–T2) is calculated from the temperature T1 and the temperature T2. The temperature difference (T1–T3) is calculated from the temperature T1 and the temperature T3.

Glass Transition Temperature

As mentioned above, a specific example of the toner having a pressure phase transition property is a toner that has at least two glass transition temperatures, in which the difference between the lowest glass transition temperature and the highest glass transition temperature is 30° C. or more. When the toner having at least two glass transition temperatures is a toner that contains a styrene resin and a (meth)acrylic acid ester resin, one of the glass transition temperature is presumed to be that of the styrene resin, and another glass transition temperature is presumed to be that of the (meth)acrylic acid ester resin.

The transparent toner may have three or more glass transition temperatures; however, the number of glass transition temperatures is preferably two. Examples of the case in which there are two glass transition temperatures include the case in which a styrene resin and a (meth)acrylic acid ester resin are the only resins contained in the toner, and the case in which the content of resins other than the styrene resin and the (meth)acrylic acid ester resin is small (for example, the content of other resins is 5 mass % or less relative to the entire toner).

When the toner has at least two glass transition temperatures and the difference between the lowest glass transition temperature and the highest glass transition temperature is 30° C. or more, the difference between the lowest glass transition temperature and the highest glass transition temperature is more preferably 40° C. or more, yet more preferably 50° C. or more, and still more preferably 60° C. or more from the viewpoint of inducing phase transition of the toner under pressure. The upper limit of the difference between the highest glass transition temperature and the lowest glass transition temperature is, for example, 140° C. or less, and may be 130° C. or less or 120° C. or less.

From the viewpoint of inducing phase transition of the toner under pressure, the lowest glass transition temperature which the toner exhibits is preferably 10° C. or less, more preferably 0° C. or less, and yet more preferably −10° C. or less. From the viewpoint of suppressing fluidization of the toner in an unpressured state, the lowest glass transition temperature is preferably −90° C. or more, more preferably −80° C. or more, and yet more preferably −70° C. or more.

From the viewpoint of suppressing fluidization of the toner in an unpressured state, the highest glass transition temperature which the toner exhibits is preferably 30° C. or more, more preferably 40° C. or more, and yet more preferably 50° C. or more. From the viewpoint of inducing phase transition of the toner under pressure, the highest glass transition temperature is preferably 70° C. or less, more preferably 65° C. or less, and yet more preferably 60° C. or less.

In the present disclosure, the glass transition temperature of the toner is determined from a differential scanning calorimetry curve (DSC curve) obtained by performing differential scanning calorimetry (DSC) on a plate-shaped sample prepared by compressing the toner. More specifically, the glass transition temperature is determined from the "extrapolated glass transition onset temperature" described in the method for determining the glass transition temperature in JIS K 7121:1987 "Testing Methods for Transition Temperatures of Plastics".

Method for Producing Transparent Toner

The transparent toner described above is obtained by preparing toner particles and then externally adding an external additive to the toner particles.

The toner particles may be produced by a dry method (for example, a kneading and pulverizing method) or a wet method (for example, an aggregation and coalescence method, a suspension polymerization method, or a dissolution suspension method). There is no limitation on these methods, and any known method may be employed. Among these methods, the aggregation and coalescence method may be employed to produce toner particles.

When the toner particles are to be produced by the aggregation and coalescence method, the toner particles are produced through, for example, the following processes:

preparing a styrene resin particle dispersion in which styrene resin particles containing a styrene resin are dispersed (styrene resin particle dispersion preparation process);

polymerizing a (meth)acrylic acid ester resin in the styrene resin particle dispersion so as to form composite resin particles containing the styrene resin and the (meth)acrylic acid ester resin (composite resin particle forming process);

aggregating the composite resin particles in the composite resin particle dispersion in which the composite resin particles are dispersed so as to form aggregated particles (aggregated particle forming process); and heating the aggregated particle dispersion in which the aggregated particles are dispersed so as to fuse and coalesce the aggregated particles and thereby form toner particles (fusing and coalescing process).

These processes will now be described in detail.

In the description below, a method for obtaining toner particles not containing a coloring agent or a releasing agent is described. A coloring agent, a releasing agent, and other additives may be used as needed. When the toner particles are to contain a coloring agent and a releasing agent, the fusing and coalescing process is performed after the composite resin particle dispersion, a coloring agent particle dispersion, and a releasing agent particle dispersion are mixed. The coloring agent particle dispersion and the releasing agent particle dispersion are, for example, prepared by mixing raw materials and then dispersing the particles in a known disperser machine. Styrene resin particle dispersion preparation process The styrene resin particle dispersion is, for example, prepared by dispersing styrene resin particles in a dispersion medium by using a surfactant.

Examples of the dispersion medium include aqueous media such as water and alcohols. These may be used alone or in combination.

Examples of the surfactant include anionic surfactants such as sulfate esters, sulfonates, phosphate esters, and soaps; cationic surfactants such as amine salts and quaternary ammonium salts; and nonionic surfactants such as polyethylene glycol, alkyl phenol-ethylene oxide adducts, and polyhydric alcohols. A nonionic surfactant may be used in combination with an anionic surfactant or a cationic surfactant. Among these, an anionic surfactant may be used. The surfactants may be used alone or in combination.

Examples of the method for dispersing the styrene resin particles in a dispersion medium include methods that involve mixing styrene resin and a dispersion medium and then dispersing the resin by stirring in a rotational shear-type homogenizer, or a mill that uses media such as a ball mill, a sand mill, or a dyno mill.

Another example of the method for dispersing styrene resin particles in a dispersion medium is an emulsion polymerization method. Specifically, after polymerization components of a styrene resin, and a chain transfer agent or a polymerization initiator are mixed, an aqueous medium containing surfactant is added to the resulting mixture, the resulting mixture is stirred to prepare an emulsion, and the styrene resin is polymerized in the emulsion. Here, the chain transfer agent may be dodecanethiol.

The volume average particle diameter of the styrene resin particles dispersed in the styrene resin particle dispersion is preferably 100 nm or more and 250 nm or less, more preferably 120 nm or more and 220 nm or less, and yet more preferably 150 nm or more and 200 nm or less.

The volume average particle diameter of the resin particles contained in the resin particle dispersion is a volume average particle diameter (D50v) determined by measuring the particle diameter with a laser-diffraction particle size distribution meter (for example, LA-700 produced by Horiba Ltd.) and determining the particle diameter at 50% accumulation in a volume-based particle size distribution calculated from the small diameter side.

The styrene resin particle content in the styrene resin particle dispersion is preferably 30 mass % or more and 60 mass % or less and is more preferably 40 mass % or more and 50 mass % or less.

Composite Resin Particle Forming Process

The styrene resin particle dispersion and (meth)acrylic acid ester monomers are mixed, and the (meth)acrylic acid ester monomer is polymerized in the styrene resin particle dispersion so as to form composite resin particles containing the styrene resin and the (meth)acrylic acid ester resin.

The composite resin particles may be resin particles containing a styrene resin and a (meth)acrylic acid ester resin that are in a microphase-separated state. The resin particles are produced by the following method, for example.

To a styrene resin particle dispersion, a group of monomers including at least two (meth)acrylic acid ester monomers are added, and, if needed, an aqueous medium is added thereto. Next, while slowly stirring the dispersion, the temperature of the dispersion is elevated to a temperature higher than or equal to the glass transition temperature of the styrene resin (for example, a temperature 10° C. to 30° C. higher than the glass transition temperature of the styrene resin). Next, while maintaining the temperature, an aqueous medium containing a polymerization initiator is slowly added dropwise, and then stirring is continued for a long time within the range of 1 to 15 hours. Here, the polymerization initiator may be ammonium persulfate.

The detailed mechanism is not clear; however, it is presumed that when the aforementioned method is employed, the monomers and the polymerization initiator penetrate into the styrene resin particles, and the (meth) acrylic acid ester monomers become polymerized inside the styrene resin particles. It is presumed that because of this mechanism, composite resin particles in which the (meth) acrylic acid ester resin is contained inside the styrene resin particles and in which the styrene resin and the (meth)acrylic acid ester resin are in a microphase-separated state inside the particles are obtained.

The volume average particle diameter of the composite resin particles dispersed in the composite resin particle dispersion is preferably 140 nm or more and 300 nm or less, more preferably 150 nm or more and 280 nm or less, and yet more preferably 160 nm or more and 250 nm or less.

The composite resin particle content in the composite resin particle dispersion is preferably 20 mass % or more and 50 mass % or less and is more preferably 30 mass % or more and 40 mass % or less.

Aggregated Particle Forming Process

The composite resin particles are aggregated in the composite resin particle dispersion so as to form aggregated particles having diameters close to the target diameter of the toner particles.

Specifically, for example, an aggregating agent is added to the composite resin particle dispersion while the pH of the composite resin particle dispersion is adjusted to acidic (for example, a pH of 2 or more and 5 or less), and after a dispersion stabilizer is added as needed, the dispersion is heated to a temperature close to the glass transition temperature of the styrene resin (specifically, for example, a temperature 10° C. to 30° C. lower than the glass transition temperature of the styrene resin) so as to aggregate the composite resin particles and form aggregated particles.

In the aggregated particle forming process, while the composite resin particle dispersion is being stirred in a rotational shear-type homogenizer, an aggregating agent may be added thereto at room temperature (for example, 25° C.) and the pH of the composite resin particle dispersion may be adjusted to acidic (for example, a pH2 or more and 5 or less), and then heating may be performed after the dispersion stabilizer is added as needed.

Examples of the aggregating agent include a surfactant having an opposite polarity to the surfactant contained in the composite resin particle dispersion, an inorganic metal salt, and a divalent or higher valent metal complex. When a metal complex is used as the aggregating agent, the amount of the surfactant used is reduced, and the charging characteristics are improved.

An additive that forms a complex with a metal ion in the aggregating agent or that forms a similar bond therewith may be used in combination with the aggregating agent as needed. An example of such an additive is a chelating agent.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the chelating agent added is preferably 0.01 parts by mass or more and 5.0 parts by mass or less and more preferably 0.1 parts by mass or more and less than 3.0 parts by mass relative to 100 parts by mass of the resin particles.

Fusing and Coalescence Process

Next, the aggregated particle dispersion containing dispersed aggregated particles is heated to, for example, a temperature equal to or higher than the glass transition temperature of the styrene resin (for example, a temperature 10° C. to 30° C. higher than the glass transition temperature of the styrene resin) to fuse and coalesce the aggregated particles and form toner particles.

The toner particles obtained through the above-described processes usually have a sea-island structure that has a sea phase containing a styrene resin and island phases that are dispersed in the sea phase and contain the (meth)acrylic acid ester resin. It is presumed that although the styrene resin and the (meth)acrylic acid ester resin are in a microphase-separated state in the composite resin particles, the styrene resin has gathered in the fusing and coalescence process to form a sea phase, and the (meth)acrylic acid ester resin has gathered to form island phases.

The average size of the island phases of the sea-island structure is controlled by, for example, increasing or decreasing the amount of the styrene resin particle dispersion or the amount of the at least two (meth)acrylic acid ester monomers used in the composite resin particle forming process, or by increasing or decreasing the length of time of maintaining a high temperature in the fusing and coalescence process.

The toner particles having a core-shell structure are produced through the following processes, for example:

after an aggregated particle dispersion is obtained, a process of mixing the aggregated particle dispersion and a styrene resin particle dispersion so that the styrene resin particles further attach to the surfaces of the aggregated particles and form second aggregated particles; and heating the second aggregated particle dispersion in which the second aggregated particles are dispersed so as to fuse and coalesce the second aggregated particles and thereby form toner particles having a core-shell structure.

The toner particles having a core-shell structure obtained through the aforementioned processes have a shell layer containing a styrene resin. Instead of the styrene resin particle dispersion, a resin particle dispersion in which a different type of resin particles are dispersed may be used to form a shell layer that contains the different type of resin.

After completion of the fusing and coalescence process, the toner particles formed in the solution are subjected to a washing process, a solid-liquid separation process, and a drying process known in the art so as to obtain dry toner particles. From the viewpoint of chargeability, the washing process may involve thorough displacement washing with ion exchange water. From the viewpoint of productivity, the solid-liquid separation process may involve suction filtration, pressure filtration, or the like. From the viewpoint of productivity, the drying process may involve freeze-drying, flash-drying, fluid-drying, vibration-type fluid-drying, or the like.

The transparent toner described above is produced by, for example, adding an external additive to the obtained toner particles in a dry state, and mixing the resulting mixture. Mixing may be performed by using a V blender, a HENSCHEL mixer, a Loedige mixer, or the like. Furthermore, if needed, a vibrating screen, an air screen, or the like may be used to remove coarse particles of the toner.

Color Toner

The color toner may be any toner that contains more than 1.0 mass % of a coloring agent in toner particles relative to the total amount of the toner particles.

The color toner contains toner particles and, if needed, an external additive.

Toner Particles

The toner particles are formed of, for example, a binder resin and, if needed, a coloring agent, a releasing agent, and other additives.

Binder Resin

Examples of the binder resin include vinyl resins composed of homopolymers of monomers and copolymers obtained by combining two or more monomers. Examples of the monomers include styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, and vinyl isopropenyl ketone), and olefins (for example, ethylene, propylene, and butadiene).

Examples of the binder resin also include non-vinyl resins such as epoxy resins, polyester resins, polyurethane resins, polyamide resins, cellulose resins, polyether resins, and modified rosin, mixtures of the vinyl resins and the non-vinyl resins described above, and graft polymers obtained by polymerizing vinyl monomers in the co-presence of these.

These binder resins may be used alone or in combination.

The binder resin may be a polyester resin.

Examples of the polyester resin include known amorphous polyester resins. An amorphous polyester resin and a crystalline polyester resin may be used in combination as the polyester resin. However, the amount of the crystalline polyester resin used relative to the entire binder resin may be in the range of 2 mass % or more and 40 mass % or less (preferably 2 mass % or more and 35 mass % or less).

Note that the "crystallinity" of a resin refers to having a clear endothermic peak instead of stepwise changes in amount of endothermic energy in differential scanning calorimetry (DSC). Specifically, "crystallinity" refers to the instance where the half-value width of the endothermic peak measured at a temperature elevation rate of 10 (° C./min) is within 10° C.

Meanwhile, the "amorphousness" of a resin refers to the instance where the half-value width exceeds 10° C., the instance where stepwise changes in amount of endothermic energy are exhibited, or the instance where a clear endothermic peak is not detected.

Amorphous Polyester Resin

Examples of the amorphous polyester resin include condensation polymers of polycarboxylic acids and polyhydric alcohols. A commercially available amorphous polyester resin may be used, or an amorphous polyester resin prepared by synthesis may be used.

Examples of the polycarboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalene dicarboxylic acid), anhydrides thereof, and lower (for example, having 1 to 5 carbon atoms) alkyl esters thereof. Among these, aromatic dicarboxylic acids may be used as the polycarboxylic acid.

For the polycarboxylic acids, a trivalent or higher carboxylic acid that has a crosslinked structure or a branched structure may be used in combination with a dicarboxylic acid. Examples of the trivalent or higher carboxylic acids include trimellitic acid, pyromellitic acid, anhydrides thereof, and lower (for example, having 1 to 5 carbon atoms) alkyl esters thereof.

The polycarboxylic acids may be used alone or in combination.

Examples of the polyhydric alcohol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, an ethylene oxide adduct of bisphenol A and a propylene oxide adduct of bisphenol A). Of these, the polyhydric alcohol is, for example, preferably an aromatic diol or an alicyclic diol, and more preferably is an aromatic diol.

For the polyhydric alcohol, a trihydric or higher alcohol that has a crosslinked structure or a branched structure may be used in combination with a diol. Examples of the trihydric or higher alcohols include glycerin, trimethylolpropane, and pentaerythritol.

The polyhydric alcohols may be used alone or in combination.

The glass transition temperature (Tg) of the amorphous polyester resin is preferably 50° C. or more and 80° C. or less and is more preferably 50° C. or more and 65° C. or less.

The weight average molecular weight (Mw) of the amorphous polyester resin is preferably 5000 or more and 1000000 or less, more preferably 7000 or more and 500000 or less, and yet more preferably 10000 or more and 300000 or less.

The number average molecular weight (Mn) of the amorphous polyester resin is preferably 2000 or more and 100000 or less and more preferably 3000 or more and 20000 or less.

The molecular weight distribution Mw/Mn of the amorphous polyester resin is preferably 1.5 or more and 100 or less and more preferably 2 or more and 60 or less.

The amorphous polyester resin is obtained by a known production method. Specifically, for example, the amorphous polyester resin is obtained by setting the polymerization temperature to 180° C. or more and 230° C. or less, decreasing the pressure in the reaction system as necessary, and performing a reaction while removing water and alcohol generated during condensation.

When the monomers used as the raw materials do not dissolve or are not compatible with each other at a reaction temperature, a solvent having a high boiling point may be added as a dissolving aid to dissolve the monomers. In this case, the polycondensation reaction is performed while distilling away the dissolving aid. When monomers poorly compatible with each other are present, the poorly compatible monomer and an acid or alcohol to be subjected to polycondensation with that monomer may be preliminarily condensed, and then the resulting product may be subjected to polycondensation with the main component.

Crystalline Polyester Resin

Examples of the crystalline polyester resin include polycondensates of polycarboxylic acids and polyhydric alcohols. A commercially available crystalline polyester resin may be used, or a crystalline polyester resin prepared by synthesis may be used.

Here, in order to simplify formation of the crystal structure, the crystalline polyester may be a polycondensate prepared by using a polymerizable monomer having a linear aliphatic group rather than a polymerizable monomer having an aromatic group.

Examples of the polycarboxylic acid include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (for example, dibasic acids such as phthalic acid, isophthalic acid, terephthalic acid, and naphthalene-2,6-dicarboxylic acid), anhydrides thereof, and lower (for example, having 1 to 5 carbon atoms) alkyl esters thereof.

For the polycarboxylic acids, a trivalent or higher carboxylic acid that has a crosslinked structure or a branched structure may be used in combination with a dicarboxylic acid. Examples of the tricarboxylic acids include aromatic carboxylic acids (for example, 1,2,3-benzenetricarboxylic acid, 1,2,4-benzenetricarboxylic acid, and 1,2,4-naphthalenetricarboxylic acid), anhydrides thereof, and lower (for example, having 1 to 5 carbon atoms) alkyl esters thereof.

For the polycarboxylic acids, these dicarboxylic acids may be used in combination with dicarboxylic acids having a sulfonic acid group or an ethylenic double bond.

The polycarboxylic acids may be used alone or in combination.

Examples of the polyhydric alcohol include aliphatic diols (for example, linear aliphatic diols having a main chain containing 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-icosanedecanediol. Among these, 1,8-octanediol, 1,9-nonanediol, and 1,10-decanediol are preferable as the aliphatic diol.

For the polyhydric alcohol, a trihydric or higher alcohol that has a crosslinked structure or a branched structure may be used in combination with a diol. Examples of the trihydric or higher alcohols include glycerin, trimethylolethane, trimethylolpropane, and pentaerythritol.

The polyhydric alcohols may be used alone or in combination.

Here, the polyhydric alcohol preferably has an aliphatic diol content of 80 mol % or more and more preferably 90 mol % or more.

The melting temperature of the crystalline polyester resin is preferably 50° C. or more and 100° C. or less, more preferably 55° C. or more and 90° C. or less, and yet more preferably 60° C. or more and 85° C. or less.

The melting temperature is determined from the DSC curve obtained by differential scanning calorimetry (DSC) by the method described in "Melting peak temperature", which is one method for determining the melting temperature in JIS K 7121-1987 "Testing Methods for Transition Temperatures of Plastics".

The weight average molecular weight (Mw) of the crystalline polyester resin may be 6,000 or more and 35,000 or less.

The crystalline polyester resin is, for example, obtained by a known production method as with the amorphous polyester resin.

The amount of the binder resin relative to the entire toner particles is, for example, preferably 40 mass % or more and 95 mass % or less, is more preferably 50 mass % or more and 90 mass % or less, and is yet more preferably 60 mass % or more and 85 mass % or less.

Coloring Agent

Examples of the coloring agent include pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These coloring agents may be used alone or in combination.

The coloring agent may be a surface treated coloring agent or may be used in combination with a dispersant, if needed. Two or more coloring agents may be used in combination.

The amount of the coloring agent relative to the entire toner particles is preferably 1 mass % or more and 30 mass % or less and is more preferably 3 mass % or more and 15 mass % or less.

Releasing Agent

Examples of the releasing agent include hydrocarbon wax; natural wax such as carnauba wax, rice wax, and candelilla wax; synthetic or mineral or petroleum wax such as montan wax; and ester wax such as fatty acid esters and montanic acid esters. The releasing agent is not limited to these.

The melting temperature of the releasing agent is preferably 50° C. or more and 110° C. or less and is more preferably 60° C. or more and 100° C. or less.

The melting temperature is determined from the DSC curve obtained by differential scanning calorimetry (DSC) by the method described in "Melting peak temperature", which is one method for determining the melting temperature in JIS K 7121-1987 "Testing Methods for Transition Temperatures of Plastics".

The releasing agent content relative to, for example, the entire toner particles is preferably 1 mass % or more and 20 mass % or less and is more preferably 5 mass % or more and 15 mass % or less.

Other Additives

Examples of other additives include known additives such as magnetic materials, charge controllers, and inorganic powder. These additives are internal additives and contained inside the toner particles.

Properties, Etc., of Toner Particles

The toner particles may be a single layer structure toner particles, or core-shell structure toner particles each constituted by a core (core particle) and a coating layer (shell) coating the core.

Core-shell toner particles may include a core containing a binder resin and, optionally, a coloring agent and other additives such as a releasing agent, and a coating layer that contains a binder resin, for example.

The volume average particle diameter (D50v) of the toner particles is preferably 2 μm or more and 10 μm or less and more preferably 4 μm or more and 8 μm or less.

The average circularity of the toner particles is preferably 0.94 or more and 1.00 or less, and more preferably 0.95 or more and 0.98 or less.

The average circularity of the toner particles is determined by (circle-equivalent perimeter)/(perimeter) [(perimeter of the circle having the same projection area as the particle image)/(perimeter of particle projection image)]. Specifically, it is the value measured by the following method.

First, toner particles to be measured are sampled by suction so as to form a flat flow, and particle images are captured as a still image by performing instantaneous strobe light emission. The particle image is analyzed by a flow particle image analyzer (FPIA-3000 produced by Sysmex Corporation) to determine the average circularity. The number of particles sampled in determining the average circularity is 3500.

When the toner contains an external additive, the toner (developer) to be measured is dispersed in surfactant-containing water, and then ultrasonically processed to obtain toner particles from which the external additive has been removed.

External Additive

Examples of the external additive include the same inorganic particles as those used as the external additive of the transparent toner.

Examples of the external additive include resin particles (resin particles of polystyrene, polymethyl methacrylate (PMMA), melamine resin, etc.), and cleaning activating agents (for example, particles metal salts of higher aliphatic acids such as zinc stearate and fluorine high molecular weight materials).

The externally added amount of the external additive is, for example, preferably 0.01 mass % or more and 5 mass % or less and is more preferably 0.01 mass % or more and 2.0 mass % or less relative to the toner particles.

Method for Producing Color Toner

Next, a method for producing a color toner is described.

The color toner is obtained by producing toner particles and then externally adding an external additive to the toner particles.

The toner particles may be produced by a dry method (for example, a kneading and pulverizing method) or a wet method (for example, an aggregation and coalescence method, a suspension polymerization method, or a dissolution suspension method). The toner particles may be made by any known process.

Among these methods, the aggregation and coalescence method may be employed to produce toner particles.

The color toner is produced by, for example, adding an external additive to the obtained dry toner particles, and mixing the resulting mixture. Mixing may be performed by using a V blender, a HENSCHEL mixer, a Loedige mixer, or the like. If needed, a vibrating screen, an air screen, or the like may be used to remove coarse particles of the toner.

Structure of toner set

The combination of a color toner and a transparent toner may be any combination in which tan δ1 and tan δ2 satisfy the aforementioned conditions.

Here, tan δ1 is 1.0 or more and 4.0 or less, and from the viewpoints of fixability of a color toner image onto a recording medium, color developability of the color toner image, and suppression of offset, tan δ1 is preferably 1.5 or more and 3.5 or less and more preferably 2 or more and 3 or less.

From the viewpoint of achieving both suppression of offset during thermal fixing and press bondability, tan δ2 is preferably 0.5 or more and 2 or less, more preferably 0.7 or more and 1.5 or less, and yet more preferably 0.8 or more and 1.3 or less.

The value of tan δ1/tan δ2 is 1.2 or more and 3.0 or less, and, from the viewpoint of achieving both suppression of offset during thermal fixing and press bondability, the value is preferably 1.5 or more and 2.9 or less and more preferably 1.8 or more and 2.5 or less.

An example of the combination of the color toner and the transparent toner is a combination of a color toner containing a polyester resin and a transparent toner containing a vinyl-based resin.

Developer Set

A developer set of this exemplary embodiment includes a first electrostatic charge image developer that contains at least the color toner in the toner set according to this exemplary embodiment, and a second electrostatic charge image developer that contains at least the transparent toner in the toner set according to this exemplary embodiment. The electrostatic charge image developers constituting the developer set of this exemplary embodiment may each be a single component developer that contains only the aforementioned toner or a two component developer that is a mixture of the toner and a carrier. When the first electrostatic charge image developer and the second electrostatic charge image developer are both two component developers, the types and contents of the carriers contained in the developers may be the same or different.

The carrier is not particularly limited and may be any known carrier. Examples of the carrier include a coated carrier prepared by covering the surface of a magnetic powder core with a resin, a magnetic powder dispersed carrier prepared by dispersing and blending magnetic powder in a matrix resin, and a resin impregnated carrier prepared by impregnating porous magnetic powder with a resin. The magnetic powder dispersed carrier and the resin impregnated carrier may each be a carrier that has a core being composed of the particles constituting the carrier and having a resin coated surface.

Examples of the magnetic powder include magnetic metals such as iron, nickel, and cobalt, and magnetic oxides such as ferrite and magnetite.

Examples of the resin for coating and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin containing an organosiloxane bond and modified products thereof, fluororesin, polyester, polycarbonate, phenolic resin, and epoxy resin. The resin for coating and the matrix resin may contain other additives, such as conductive particles. Examples of the conductive particles include particles of metals such as gold, silver, and copper, and particles of carbon black, titanium oxide, zinc oxide, tin oxide, barium sulfate, aluminum borate, and potassium titanate.

An example of the method for covering the surface of the core with the resin is a method that involves coating the surface of the core with a coating layer-forming solution prepared by dissolving the resin for coating and various additives (used as needed) in an appropriate solvent. The solvent is not particularly limited and may be selected by considering the type of the resin to be used, suitability of application, etc.

Specific examples of the resin coating method include a dipping method involving dipping cores in the coating layer forming solution, a spraying method involving spraying the coating layer forming solution onto core surfaces, a fluid bed method involving spraying a coating layer forming solution while having the cores float on a bed of air, and a kneader coater method involving mixing cores serving as carriers and a coating layer forming solution in a kneader coater and then removing the solvent.

In a two component developer, the toner to carrier mixing ratio (mass ratio) is preferably 1:100 to 30:100 and is more preferably 3:100 to 20:100.

Apparatus and Method for Producing Printed Material

An apparatus for producing a printed material according to this embodiment includes a color toner image forming unit that contains a first electrostatic charge image developer containing the color toner in the toner set of this exemplary embodiment and that electrographically forms a color toner image on a recording medium by using the first electrostatic charge image developer; a transparent toner layer forming unit that contains a second electrostatic charge image developer containing the transparent toner in the toner set of this exemplary embodiment and that electrophotographically adds the transparent toner to form a transparent toner layer on the recording medium; a thermal fixing unit that includes a fixing member and thermally fixes the color toner image onto the recording medium while the fixing member contacts the transparent toner layer; and a press bonding unit that folds and press-bonds the recording medium having the color toner image thermally fixed thereon or that superimposes another recording medium onto the recording medium having the color toner image thermally bonded thereto and press-bonds these recording media.

A method for forming a printed material of this exemplary embodiment is performed by using the apparatus for forming a printed material of this exemplary embodiment.

The method for producing a printed material according to this embodiment includes a color toner image forming process of electrographically forming a color toner image on a recording medium by using a first electrostatic charge image developer that contains the color toner in the toner set of this exemplary embodiment; forming a transparent toner layer by electrophotographically forming a transparent toner on the recording medium by using a second electrostatic charge image developer that contains the transparent toner in the toner set of this exemplary embodiment; a thermal fixing process of thermally fixing the color toner image onto the recording medium while a fixing member contacts the transparent toner layer; and a press-bonding process of folding and press-bonding the recording medium having the color toner image thermally fixed thereon or superimposing another recording medium onto the recording medium having the color toner image thermally fixed thereon and press-bonding these recording media.

The color toner image forming unit included in the apparatus for producing a printed material according to this exemplary embodiment includes, for example, a photoreceptor, a charging unit that charges a surface of the photoreceptor, an electrostatic charge image forming unit that forms an electrostatic charge image on the charged surface of the photoreceptor, a developing unit that contains a first electrostatic charge image developer containing the color toner in the toner set of the exemplary embodiment and that develops the electrostatic charge image on the surface of the photoreceptor into a color toner image by using the first electrostatic charge image developer, and a transfer unit that transfers the toner image on the surface of the photoreceptor onto a surface of a recording medium.

The transparent toner layer forming unit included in the apparatus for producing a printed material according to this exemplary embodiment includes, for example, a photoreceptor, a charging unit that charges a surface of the photoreceptor, an electrostatic charge image forming unit that forms an electrostatic charge image on the charged surface of the photoreceptor, a developing unit that contains a second electrostatic charge image developer containing the transparent toner in the toner set of the exemplary embodiment and that develops the electrostatic charge image on the surface of the photoreceptor into a transparent toner layer by using the second electrostatic charge image developer, and a transfer unit that transfers the transparent toner layer on the surface of the photoreceptor onto a surface of a recording medium.

The color toner image forming process included in the method for producing a printed material according to this exemplary embodiment includes, for example, a charging process of charging a surface of a photoreceptor, an electrostatic charge image forming process of forming an electrostatic charge image on the charged surface of the photoreceptor, a developing process of developing the electrostatic charge image on the surface of the photoreceptor into a color toner image by using a first electrostatic charge image developer that contains the color toner in the toner set according to this exemplary embodiment, and a transfer process of transferring the color toner image on the surface of the photoreceptor onto a surface of a recording medium.

The transparent toner layer forming process included in the method for producing a printed material according to this exemplary embodiment includes, for example, a charging process of charging a surface of a photoreceptor, an electrostatic charge image forming process of forming an electrostatic charge image on the charged surface of the photoreceptor, a developing process of developing the electrostatic charge image on the surface of the photoreceptor into a transparent toner layer by using a second electrostatic charge image developer that contains the transparent toner in the toner set according to this exemplary embodiment, and a transfer process of transferring the transparent toner layer on the surface of the photoreceptor onto a surface of a recording medium.

The color toner image forming unit is, for example, a direct transfer type device with which a color toner image on the surface of the photoreceptor is directly transferred onto a recording medium; an intermediate transfer type device with which a color toner image on the surface of the photoreceptor is first transferred onto a surface of an intermediate transfer body and then the color toner image on the intermediate transfer body is transferred onto a surface of a recording medium; a device equipped with a cleaning unit that cleans the surface of the photoreceptor before charging and after the transfer of the color toner image; and a device equipped with a charge erasing unit that erases charges on the surface of the photoreceptor by applying charge erasing light after the transfer of the color toner image and before charging. When the color toner image forming unit is of an intermediate transfer type, the transfer unit includes, for example, an intermediate transfer body having a surface onto which a color toner image is transferred, a first transfer unit that transfers the color toner image on the surface of the photoreceptor onto the surface of the intermediate transfer body, and a second transfer unit transfers the color toner image on the surface of the intermediate transfer body onto a surface of a recording medium.

The transparent toner layer forming unit is, for example, a direct transfer type device with which a transparent toner layer on the surface of the photoreceptor is directly transferred onto a recording medium having a color toner image formed thereon; an intermediate transfer type device with which the transparent toner layer on the surface of the photoreceptor is first transferred onto a surface of an intermediate transfer body and then the transparent toner layer on the surface of the intermediate transfer body is transferred onto a surface of a recording medium; a device equipped with a cleaning unit that cleans the surface of the photoreceptor before charging and after the transfer of the transparent toner layer; and a device equipped with a charge erasing unit that erases charges on the surface of the photoreceptor by applying charge erasing light after the transfer of the transparent toner layer and before charging. When the transparent toner layer forming unit is of an intermediate transfer type, the transfer unit includes, for example, an intermediate transfer body having a surface onto which a transparent toner layer is transferred, a first transfer unit that transfers the transparent toner layer on the surface of the photoreceptor onto the surface of the intermediate transfer body, and a second transfer unit transfers the transparent toner layer on the surface of the intermediate transfer body onto a surface of a recording medium.

The color toner image forming unit and the transparent toner layer forming unit may each have a section including the developing unit, and this section may be configurated as a cartridge structure (process cartridge) that is detachably attachable to the color toner image forming unit or the transparent toner layer forming unit. A process cartridge equipped with a developing unit and containing the electrostatic charge image developer in the developer set of the exemplary embodiment may be used as this process cartridge. The process cartridge may be configured as a process cartridge set that includes a first process cartridge equipped with a first developing unit containing a first electrostatic charge image developer and a second process cartridge equipped with a second developing unit containing a second electrostatic charge image developer.

The press bonding unit included in the apparatus for producing a printed material according to this embodiment applies pressure to a recording medium on which the transparent toner from the toner set of the exemplary embodiment is placed. In this manner, the transparent toner is fluidized and exhibits bondability on the recording medium. The pressure that the press bonding unit applies to the recording medium to fluidize the transparent toner is preferably 3 MPa or more and 300 MPa or less, more preferably 10 MPa or more and 200 MPa or less, and yet more preferably 30 MPa or more and 150 MPa or less.

The transparent toner in the toner set of this exemplary embodiment may be placed on the entire surface of the recording medium or on some part of the recording medium. The transparent toner in the toner set of this exemplary embodiment placed on a recording medium may form one layer or two or more layers. The layer of the transparent toner in the toner set of this exemplary embodiment may be a layer continuous in the surface direction of the recording medium or a layer discontinuous in the surface direction of the recording medium.

The amount of the transparent toner on the recording medium placed in the region is, for example, 0.5 $g/m^2$ or more and 50 $g/m^2$ or less, 1 $g/m^2$ or more and 40 $g/m^2$ or less, or 1.5 g/m$^2$ or more and 30 g/m$^2$ or less. The thickness of the layer of the transparent toner on the recording medium is, for example, 0.2 μm or more and 25 μm or less, 0.4 μm or more and 20 μm or less, or 0.6 μm or more and 15 μm or less.

Examples of the recording medium used in the apparatus for producing a printed material according to this exemplary embodiment include paper, coated paper obtained by coating the surface of paper with a resin or the like, cloths, nonwoven cloths, resin films, and resin sheets. The recording medium may have an image on one surface or both surfaces.

Although some examples of the apparatus for producing a printed material according to the present exemplary embodiment are described below, the exemplary embodiments are not limited to these.

FIG. 1 is a schematic diagram illustrating a section that includes a transparent toner layer forming unit and a press bonding unit in one example of the apparatus for producing a printed material according to this exemplary embodiment. The apparatus for producing a printed material illustrated in FIG. 1 is equipped with a transparent toner layer forming unit 100 and a press bonding unit 200 downstream of the transparent toner layer forming unit 100. The arrow indicates the direction in which the photoreceptor rotates or the recording medium is conveyed.

The transparent toner layer forming unit 100 is of a direct transfer type and uses a developer containing the transparent toner in the toner set of the exemplary embodiment to electrophotographically place the transparent toner on a recording medium P having a color toner image formed thereon. The recording medium P has a color toner image formed on one or both surfaces in advance.

The transparent toner layer forming unit 100 includes a photoreceptor 101. A charging roll (one example of the charging unit) 102 that charges the surface of the photoreceptor 101, an exposing device (one example of the electrostatic charge image forming unit) 103 that forms an electrostatic charge image by exposing the charged surface of the photoreceptor 101 with a laser beam, a developing device (one example of the developing unit) 104 that develops the electrostatic charge image by supplying a toner to the electrostatic charge image, a transfer roll (one example of the transfer unit) 105 that transfers the developed toner image onto the recording medium P, and a photoreceptor cleaning device (one example of the cleaning unit) 106 that removes the toner remaining on the surface of the photoreceptor 101 after the transfer are provided around the photoreceptor 101.

The operation of the transparent toner layer forming unit 100 forming the transparent toner on the recording medium P will now be described.

First, the surface of the photoreceptor 101 is charged by the charging roll 102. The developing device 103 applies a laser beam onto the charged surface of the photoreceptor 101 in accordance to image data sent from a controller (not illustrated). As a result, an electrostatic charge image of a transparent toner placement pattern is formed on the surface of the photoreceptor 101.

The electrostatic charge image formed on the photoreceptor 101 is rotated to a developing position as the photoreceptor 101 is run. The electrostatic charge image on the photoreceptor 101 is developed by the developing device 104 at this developing position so as to form a transparent toner layer.

A developer that contains at least the transparent toner and a carrier is contained in the developing device 104. The transparent toner is frictionally charged as it is stirred with the carrier in the developing device 104, and is carried on the developer roll. As the surface of the photoreceptor 101 passes the developing device 104, the transparent toner electrostatically adheres to the electrostatic charge image on the surface of the photoreceptor 101, and the electrostatic charge image is thereby developed with the transparent toner. The photoreceptor 101 on which the transparent toner layer composed of the transparent toner is formed is continuously run, and the developed transparent toner layer on the photoreceptor 101 is conveyed to a transfer position.

After the transparent toner layer on the photoreceptor 101 is conveyed to the transfer position, a transfer bias is applied to the transfer roll 105. An electrostatic force working from the photoreceptor 101 toward the transfer roll 105 also acts on the transparent toner layer, and, thus, the transparent toner layer on the photoreceptor 101 is transferred onto the recording medium P.

The transparent toner remaining on the photoreceptor 101 is removed by the photoreceptor cleaning device 106 and recovered. The photoreceptor cleaning device 106 is, for example, a cleaning blade or a cleaning brush. From the viewpoint of suppressing pressure-induced fluidization of the transparent toner remaining on the surface of the photoreceptor and attachment of the film-like fluidized transparent toner onto the surface of the photoreceptor, the photoreceptor cleaning device 106 may be a cleaning brush.

The recording medium P having the transparent toner layer transferred thereon is conveyed to a fixing device (one example of the fixing unit) 107. The fixing device 107 is, for example, a pair of fixing members (roll/roll or belt/roll). The pressure which the fixing device 107 applies to the recording medium P may be lower than the pressure which a pressurizing device 230 applies to the recording medium P, and may specifically be 0.2 MPa or more and 1 MPa or less.

The fixing device 107 may have a heating source (for example, a halogen heater) for heating the recording medium inside. When the fixing device 107 has a heating source inside, the surface temperature of the recording medium P heated by the heating source is preferably 150° C. or more and 220° C. or less, more preferably 155° C. or more and 210° C. or less, and yet more preferably 160° C. or more and 200° C. or less. The fixing device 107 may have no heating source inside, and this does not exclude that the temperature inside the fixing device 107 increases to a temperature equal to or more than the environment temperature due to heat from a motor in the transparent toner layer forming unit 100 or the like.

The recording medium P passes the transparent toner layer forming unit 100 and thus becomes a recording medium P1 having a transparent toner applied on an image. The recording medium P1 is conveyed toward the press bonding unit 200.

In the apparatus for producing a printed material according to this exemplary embodiment, the transparent toner layer forming unit 100 and the press bonding unit 200 may be close to each other or distant from each other. When the transparent toner layer forming unit 100 and the press bonding unit 200 are distant from each other, the transparent toner layer forming unit 100 and the press bonding unit 200 are, for example, linked via a conveying unit (for example, a belt conveyor) that conveys the recording medium P1.

The press bonding unit 200 is equipped with a folding device 220 and a pressurizing device 230, and folds and press-bonds the recording medium P1.

The folding device 220 folds the recording medium P1 passing therethrough to prepare a folded recording medium P2. The way in which the recording medium P2 is folded may be in two, in three, or in four, and only part of the recording medium P2 may be in fold. The recording medium P2 is in a state in which the transparent toner is placed on at least part of at least one surface of opposing two surfaces.

The folding device 220 may have a pair of pressurizing members (for example, roll/roll or belt/roll) that apply pressure to the recording medium P2. The pressure which the pressurizing members of the folding device 220 apply to the recording medium P2 may be lower than the pressure which the pressurizing device 230 applies to the recording medium P2, and may specifically be 1 MPa or more and 10 MPa or less.

The press bonding unit 200 may be equipped with a superimposing device that superimposes another recording medium on the recording medium P1 instead of the folding device 220. The form of superimposition of the recording medium P1 and another recording medium may be such that one recording medium is superimposed on the recording medium P1 or that one recording medium is superimposed on each of multiple sections of the recording medium P1. This other recording medium may have an image formed on one or both surfaces in advance, may be free of any image, or may be a press-bonded printed material prepared in advance.

The recording medium P2 exits the folding device 220 (or superimposing device) and is conveyed toward the pressurizing device 230.

The pressurizing device 230 is equipped with a pair of pressurizing members (in other words, pressurizing rolls 231 and 232). The pressurizing roll 231 and the pressurizing roll 232 contact and push each other at their outer peripheral surfaces to apply pressure onto the passing recording medium P2. The pair of pressurizing members in the pressurizing device 230 is not limited to the combination of pressurizing rolls and may be a combination of a pressurizing roll and a pressurizing belt or a combination of a pressurizing belt and a pressurizing belt.

When pressure is applied to the recording medium P2 passing the pressurizing device 230, the transparent toner on the recording medium P2 is fluidized under pressure and exhibits bondability. The pressure that the pressurizing device 230 applies to the recording medium P2 is preferably 3 MPa or more and 300 MPa or less, more preferably 10 MPa or more and 200 MPa or less, and yet more preferably 30 MPa or more and 150 MPa or less.

The pressurizing device 230 may have a heating source (for example, a halogen heater) for heating the recording medium P2 inside. When the pressurizing device 230 has a heating source inside, the surface temperature of the recording medium P2 heated by the heating source is preferably 30° C. or more and 120° C. or less, more preferably 40° C. or more and 100° C. or less, and yet more preferably 50° C. or more and 90° C. or less. The pressurizing device 230 may have no heating source inside, and this does not exclude that the temperature inside the pressurizing device 230 increases to a temperature equal to or more than the environment temperature due to heat from a motor in the pressurizing device 230 or the like.

As the recording medium P2 passes the pressurizing device 230, the surfaces of the overlapping flaps of the recording medium P2 become bonded with each other with the fluidized transparent toner, and a press-bonded printed material P3 is obtained. The opposing surfaces of the overlapping flaps of the press-bonded printed material P3 are partly or entirely bonded to each other.

The finished press-bonded printed material P3 is discharged from the pressurizing device 230.

A first model of the press-bonded printed material P3 is a press-bonded printed material in which a folded recording medium has opposing surfaces bonded to each other with the transparent toner. The press-bonded printed material P3 of this model is produced by the apparatus for producing a printed material equipped with a folding device 220.

A second model of the press-bonded printed material P3 is a press-bonded printed material in which multiple recording media placed on top of each other have opposing surfaces bonded to each other with the transparent toner. The press-bonded printed material P3 of this model is produced by the apparatus for producing a printed material equipped with a superimposing device.

The apparatus for producing a printed material according to this exemplary embodiment is not limited to a type that continuously conveys the recording medium P2 from the folding device 220 (or superimposing device) to the pressurizing device 230. The apparatus for producing a printed material according to this exemplary embodiment may be of a type that stocks the recording media P2 discharged from the folding device 220 (or superimposing device) and conveys the recording media P2 to the pressurizing device 230 after a predetermined amount of the recording media P2 are stored.

In the apparatus for producing a printed material according to this exemplary embodiment, the folding device 220 (or superimposing device) and the pressurizing device 230 may be close to each other or distant from each other. When the folding device 220 (or superimposing device) and the pressurizing device 230 are distant from each other, the folding device 220 (of superimposing device) and the pressurizing device 230 are, for example, linked via a conveying unit (for example, a belt conveyor) that conveys the recording medium P2.

The apparatus for producing a printed material according to this exemplary embodiment may be equipped with a cutting unit that cuts the recording medium into a predetermined size. Examples of the cutting unit include a cutting unit that is disposed between the transparent toner layer forming unit 100 and the press bonding unit 200 and cuts off a part of the recording medium P1, the part being a region where no transparent toner is placed; a cutting unit that is disposed between the folding device 220 and the pressurizing device 230 and cuts off a part of the recording medium P2, the part being a region where no transparent toner is placed; and a cutting unit that is disposed downstream of the press bonding unit 200 and cuts off a part of the press-bonded printed material P3, the part being a region not bonded with the transparent toner.

The apparatus for producing a printed material according to this exemplary embodiment is not limited to a single-sheet type. The apparatus for producing a printed material according to this exemplary embodiment may be of a type that performs a transparent toner layer forming process and a press bonding process on a long recording medium to form a long press-bonded printed material, and then cuts the long press-bonded printed material into a predetermined size.

Although other examples of the apparatus for producing a printed material according to the present exemplary embodiment equipped with a color toner image forming unit are described below, the exemplary embodiment is not limited to these. Only relevant sections illustrated in the drawings are described in the description below, and descriptions of other sections are omitted.

Figure 2:
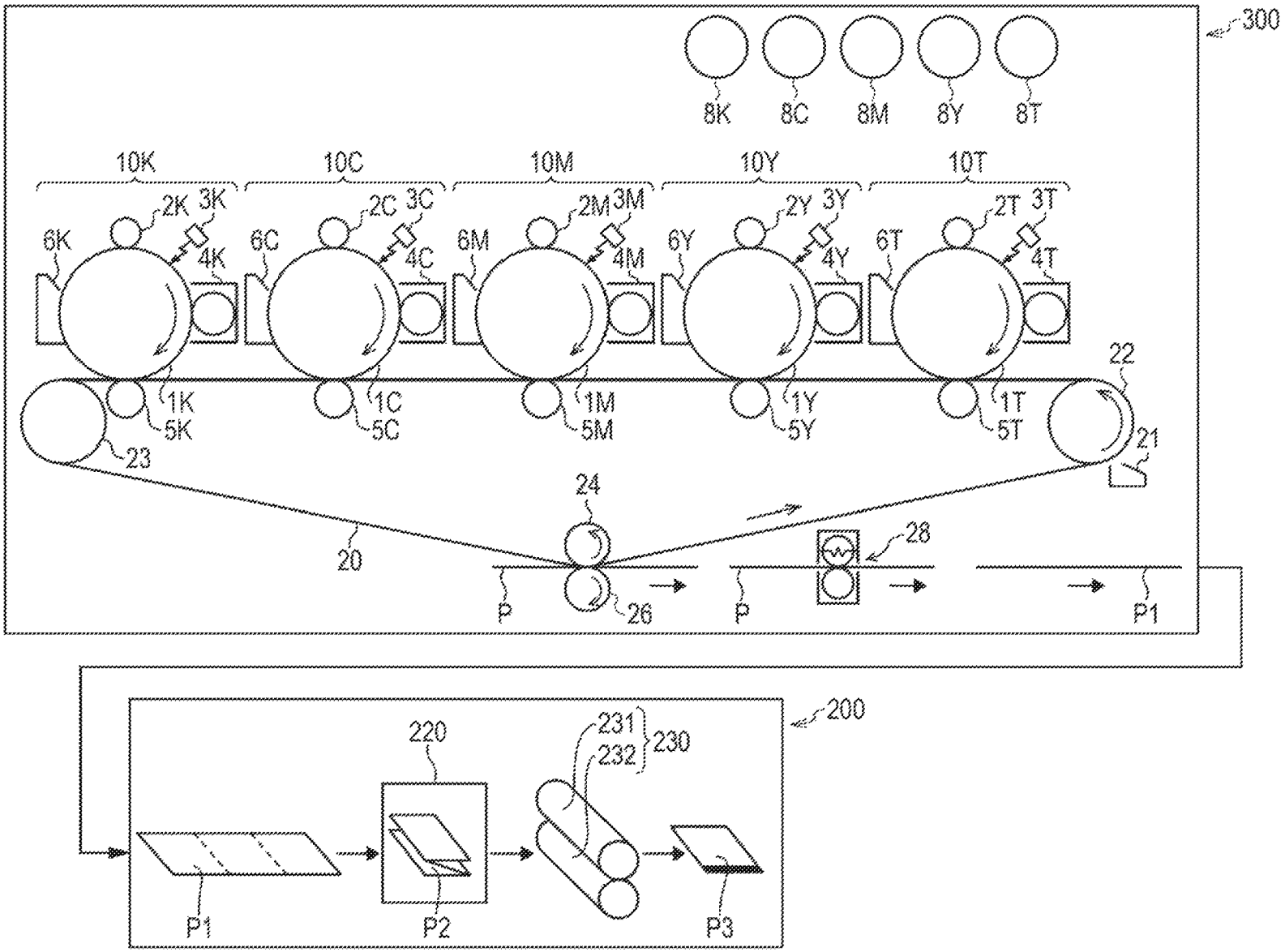
FIG. 2 is a schematic view illustrating another example of the apparatus for producing a printed material according to this exemplary embodiment.

FIG. 2 is a schematic diagram of another example of an apparatus for producing a printed material according to this exemplary embodiment. The apparatus for producing a printed material illustrated in FIG. 2 is equipped with a printing unit 300 that places a transparent toner on a recording medium and forms color toner images, and a press bonding unit 200 disposed downstream of the printing unit 300.

The printing unit 300 is a five-stand-tandem intermediate transfer-type printing unit. The printing unit 300 is equipped with a unit 10T in which the transparent toner (T) is placed, and units 10Y, 10M, 10C, and 10K that respectively form color toner images of yellow (Y), magenta (M), cyan (C), and black (K) in color. The unit 10T is the transparent toner layer forming unit that places the transparent toner on the recording medium P by using a developer that contains the transparent toner. Each of the units 10Y, 10M, 10C, and 10K is a unit that forms a color toner on the recording medium P by using a developer that contains the color toner. The units 10T, 10Y, 10M, 10C, and 10K employ an electrophotographic system.

The units 10T, 10Y, 10M, 10C, and 10K are disposed side by side with spaces therebetween in the horizontal direction. The units 10T, 10Y, 10M, 10C, and 10K may each be a process cartridge detachably attachable to the printing unit 300.

An intermediate transfer belt (one example of the intermediate transfer body) 20 extends below and throughout the units 10T, 10Y, 10M, 10C, and 10K. The intermediate transfer belt 20 is wound around a driving roll 22, a supporting roll 23, and a counter roll 24 that are in contact with the inner surface of the intermediate transfer belt 20, and runs in a direction from the unit 10T to the unit 10K. An intermediate transfer body cleaning device 21 is installed on the image carrying surface side of the intermediate transfer belt 20 so as to face the driving roll 22.

The units 10T, 10Y, 10M, 10C, and 10K are respectively equipped with developing devices (examples of developing units) 4T, 4Y, 4M, 4C, and 4K. A transparent toner, a yellow toner (color toner), a magenta toner (color toner), a cyan toner (color toner), and a black toner (color toner) contained in toner cartridges 8T, 8Y, 8M, 8C, and 8K are respectively supplied to the developing devices 4T, 4Y, 4M, 4C, and 4K.

Since the units 10T, 10Y, 10M, 10C, and 10K are identical in structure and in operation, the unit 10T that places the transparent toner on the recording medium is described as a representative example.

The unit 10T has a photoreceptor 1T. A charging roll (one example of the charging unit) 2T that charges the surface of the photoreceptor 1T, an exposing device (one example of the electrostatic charge image forming unit) 3T that forms an electrostatic charge image by exposing the charged surface of the photoreceptor 1T with a laser beam, a developing device (one example of the developing unit) 4T that develops the electrostatic charge image by supplying a toner to the electrostatic charge image, a first transfer roll (one example of the first transfer unit) 5T that transfers the developed toner image onto the intermediate transfer belt 20, and a photoreceptor cleaning device (one example of the cleaning unit) 6T that removes the toner remaining on the surface of the photoreceptor 1T after the first transfer are provided in that order around the photoreceptor 1T. The first transfer roll 5T is disposed on the inner side of the intermediate transfer belt 20 and is positioned to face the photoreceptor 1T.

In the description below, operation of transparent toner layer forming a transparent toner on the recording medium P and forming color toner images is described by describing the operation of the unit 10T as an example.

First, the surface of the photoreceptor 1T is charged by the charging roll 2T. The developing device 3T applies a laser beam onto the charged surface of the photoreceptor 1T in accordance to image data sent from a controller (not illustrated). As a result, an electrostatic charge image of a transparent toner placement pattern is formed on the surface of the photoreceptor 1T.

The electrostatic charge image formed on the photoreceptor 1T is rotated to a developing position as the photoreceptor 1T is run. The electrostatic charge image on the photoreceptor 1T is developed and visualized with the developing device 4T at this developing position so as to form a toner image.

A developer that contains at least the transparent toner and a carrier is contained in the developing device 4T. The transparent toner is frictionally charged as it is stirred with the carrier in the developing device 4T, and is carried on the developer roll. As the surface of the photoreceptor 1T passes the developing device 4T, the toner electrostatically adheres to the electrostatic charge image on the surface of the photoreceptor 1T, and the electrostatic charge image is thereby developed with the toner. The photoreceptor 1T on which the toner image formed of the toner is formed is continuously run, and the developed toner image on the photoreceptor 1T is conveyed to a first transfer position.

After the toner image on the photoreceptor 1T is conveyed to the first transfer position, a first transfer bias is applied to the first transfer roll 5T. Electrostatic force working from the photoreceptor 1T toward the first transfer roll 5T also works on the toner image, and the toner image on the photoreceptor 1T is transferred onto the intermediate transfer belt 20. The toner remaining on the photoreceptor 1T is removed by the photoreceptor cleaning device 6T and recovered. The photoreceptor cleaning device 6T is, for example, a cleaning blade or a cleaning brush, and is preferably a cleaning brush.

An operation similar to that performed in the unit 10T is performed in the units 10Y, 10M, 10C, and 10K also by using a developer that contains a color toner. The intermediate transfer belt 20 onto which the transparent toner layer formed of the transparent toner in the unit 10T has been transformed sequentially passes the units 10Y, 10M, 10C, and 10K, and color toner images of respective colors are transferred onto the intermediate transfer belt 20 in a superimposing manner.

The intermediate transfer belt 20 onto which five toner images (in other words, the transparent toner layer and four color toner images) are transferred as the intermediate transfer belt 20 passes the units 10T, 10Y, 10M, 10C, and 10K reaches a second transfer section constituted by the intermediate transfer belt 20, the counter roll 24 in contact with the inner surface of the intermediate transfer belt 20, and a second transfer roll (one example of the second transfer unit) 26 disposed on the image-carrying surface side of the intermediate transfer belt 20. Meanwhile, the recording medium P is supplied to a gap where the second transfer roll 26 and the intermediate transfer belt 20 contact each other via a supplying mechanism, and a second transfer bias is applied to the counter roll 24. During this process, an electrostatic force working from the intermediate transfer belt 20 toward the recording medium P acts on the toner images, and the toner images on the intermediate transfer belt 20 are transferred onto the recording medium P.

The recording medium P onto which the toner images have been transferred is conveyed to a thermal fixing device (one example of the thermal fixing unit) 28. The thermal fixing device 28 is equipped with a heating source such as a halogen heater, and heats the recording medium P. The surface temperature of the recording medium P when heated by the thermal fixing device 28 is preferably 150° C. or more and 220° C. or less, more preferably 155° C. or more and 210° C. or less, and yet more preferably 160° C. or more and 200° C. or less. As the recording medium P passes the thermal fixing device 28, the color toner images are thermally fixed to the recording medium P.

From the viewpoints of suppressing detachment of the transparent toner from the recording medium P and improving the fixability of the color toner images to the recording medium P, the thermal fixing device 28 may be a device that applies heat and pressure, for example, a pair of fixing members (roll/roll or belt/roll) equipped with a heating sources inside. When the thermal fixing device 28 is to apply pressure, the pressure which the thermal fixing device 28 applies to the recording medium P may be lower than the pressure which the pressurizing device 230 applies to the recording medium P2, and may specifically be 0.2 MPa or more and 1 MPa or less.

The recording medium P passes the printing unit 300, and thus becomes a recording medium P1 onto which color toner images and a transparent toner have been applied. The recording medium P1 is conveyed toward the press bonding unit 200.

The structure of the press bonding unit 200 illustrated in FIG. 2 may be the same as that of the press bonding unit 200 illustrated in FIG. 1, and the detailed descriptions of the structure and the operation of the press bonding unit 200 are omitted.

In the apparatus for producing a printed material according to this exemplary embodiment, the printing unit 300 and the press bonding unit 200 may be close to each other or distant from each other. When the printing unit 300 and the press bonding unit 200 are distant from each other, the printing unit 300 and the press bonding unit 200 are, for example, linked via a conveying unit (for example, a belt conveyor) that conveys the recording medium P1.

The apparatus for producing a printed material according to this exemplary embodiment may be equipped with a cutting unit that cuts the recording medium into a predetermined size. Examples of the cutting unit include a cutting unit that is disposed between the printing unit 300 and the press bonding unit 200 and cuts off a part of the recording medium P1, the part being a region where no transparent toner is placed; a cutting unit that is disposed between the folding device 220 and the pressurizing device 230 and cuts off a part of the recording medium P2, the part being a region where no transparent toner is placed; and a cutting unit that is disposed downstream of the press bonding unit 200 and cuts off a part of the press-bonded printed material P3, the part being a region not bonded with the transparent toner.

The apparatus for producing a printed material according to this exemplary embodiment is not limited to a single-sheet type. The apparatus for producing a printed material according to this exemplary embodiment may be of a type that performs a color toner image forming process, a transparent toner layer forming process, and a press bonding process on a long recording medium to form a long press-bonded printed material, and then cuts the long press-bonded printed material into a predetermined size. Process cartridge set A process cartridge set according to an exemplary embodiment is described.

A process cartridge set according to this exemplary embodiment includes a first process cartridge equipped with a first developing unit that contains a first electrostatic charge image developer containing the color toner in the toner set of the present exemplary embodiment and that develops an electrostatic charge image for a color toner image formed on the surface of the photoreceptor by using the first electrostatic charge image developer so as to form a color toner image; and a second process cartridge equipped with a second developing unit that contains a second electrostatic charge image developer containing the transparent toner in the toner set of the present exemplary embodiment and that develops an electrostatic charge image for a transparent toner layer formed on the surface of the photoreceptor by using the second electrostatic charge image developer so as to form a transparent toner layer. The process cartridge set is detachably attachable to the apparatus for producing a printed material.

Each of the process cartridges constituting the process cartridge set of this exemplary embodiment may be configured to include a developing unit and, if needed, at least one selected from a photoreceptor, a charging unit, an electrostatic charge image forming unit, a transfer unit, and other units.

One example of the process cartridge set of the exemplary embodiment is described below, but this example is not limiting. Only relevant sections illustrated in the drawing are described in the description below, and descriptions of other sections are omitted.

Figure 3:
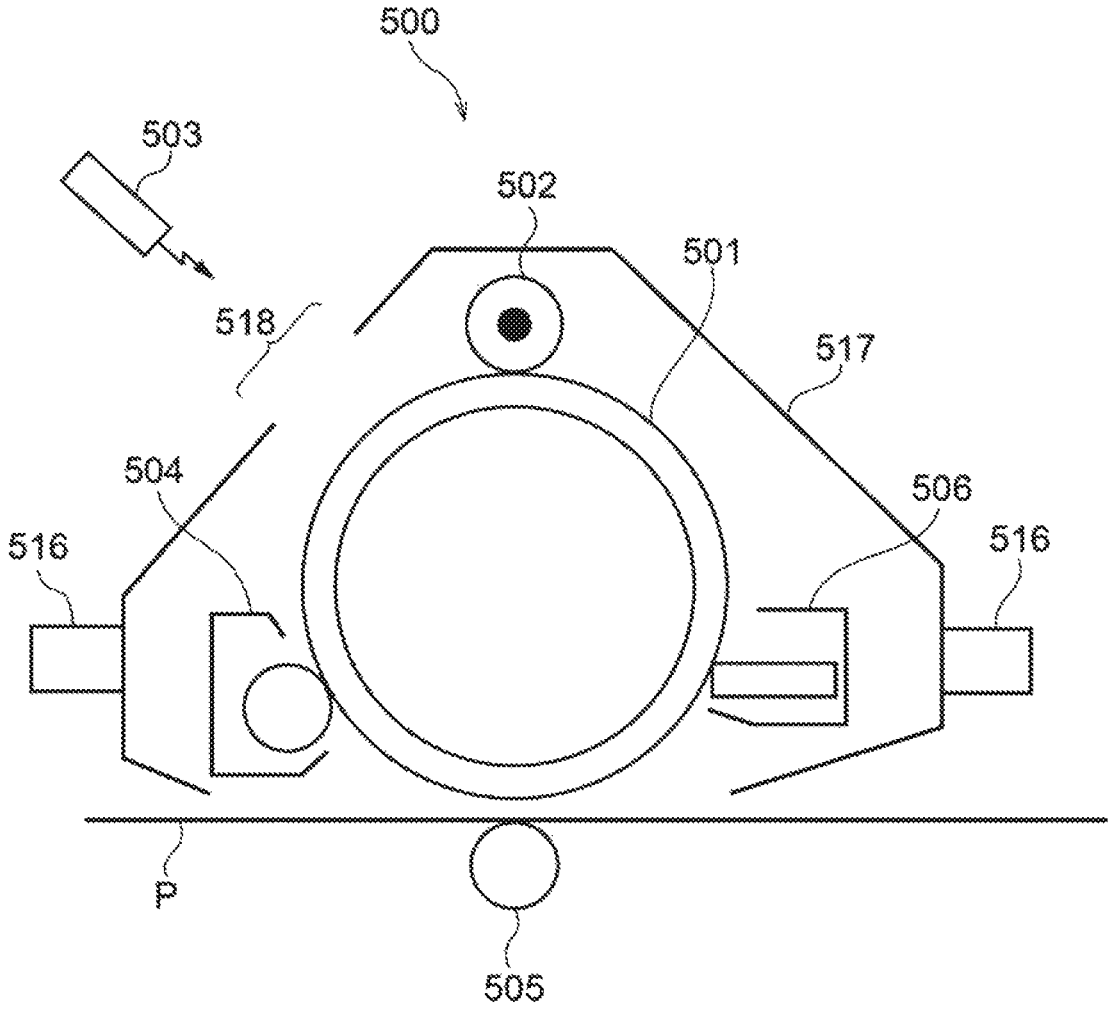
FIG. 3 is a schematic view illustrating one example of a first process cartridge constituting a process cartridge according to an exemplary embodiment.

FIG. 3 is a schematic diagram illustrating one example of the first process cartridge constituting the process cartridge set of this exemplary embodiment.

A process cartridge 500 illustrated in FIG. 3 is detachably attachable to the apparatus for producing a printed material illustrated in FIG. 1 or 2.

The process cartridge 500 includes a photoreceptor 501, and a charging roll 502 (one example of the charging unit), a developing device 504 (one example of the developing unit), and a photoreceptor cleaning device 506 (one example of the cleaning unit) that are disposed around the photoreceptor 501. A housing 517 integrates these units and members into a cartridge. The housing 517 has an opening 518 to allow exposure. The housing 517 has an installation rail 516, and the process cartridge 500 is installed to the apparatus for producing a printed material by using the installation rail 516.

FIG. 3 also illustrates an exposing device 503 and a transfer device 505 that are disposed around the process cartridge 500 when the process cartridge 500 is installed to the apparatus for producing a printed material. FIG. 3 also illustrates a recording medium P.

Toner Cartridge Set

A toner cartridge set of this exemplary embodiment includes a first toner cartridge containing the color toner in the toner set of the exemplary embodiment, and a second toner cartridge containing the transparent toner in the toner set of the exemplary embodiment, and is detachably attachable to an apparatus for producing a printed material. Each of the toner cartridges constituting the toner cartridge set contains a replenishment toner to be supplied to the developing unit installed inside the apparatus for producing a printed material.

The printing unit 300 illustrated in FIG. 2 is configured so that a toner cartridge set constituted by the toner cartridges 8T, 8Y, 8M, 8C, and 8K is detachably attachable to the printing unit 300. The toner cartridges 8T, 8Y, 8M, 8C, and 8K are connected to the developing devices 4T, 4Y, 4M, 4C, and 4K, respectively, via toner supplying tubes not illustrated in the drawings. The toner cartridge 8T, which is the first toner cartridge constituting the toner cartridge set of the exemplary embodiment, contains a transparent toner. The toner cartridges 8Y, 8M, 8C, and 8K, which are second toner cartridges constituting the toner cartridge set of the exemplary embodiment, respectively contain color toners of yellow, magenta, cyan, and black in color. When the toners contained in the toner cartridges have run low, the toner cartridges are replaced.

EXAMPLES

The exemplary embodiments of the present disclosure will now be described in detail through examples, but the present disclosure is not limited by these examples. In the description below, "parts" and "%" are on a mass basis unless otherwise noted.

Example A

Preparation of Core Resin Particles for Transparent Toner

Preparation of Core Resin Particle Dispersion (A1)

Styrene: 450 parts n-Butyl acrylate: 138 parts

Acrylic acid: 18 parts

Dodecanethiol: 9 parts

The above-described components are mixed and dissolved to prepare a solution A.

Meanwhile, 10 parts of an anionic surfactant (DOWFAX 2A1 produced by The Dow Chemical Company) is dissolved in 250 parts of ion exchange water, and is dispersed in a flask by adding the aforementioned solution A to perform emulsification (monomer emulsion A).

In 555 parts of ion exchange water, 1 part of the same anionic surfactant (DOWFAX 2A1 produced by The Dow Chemical Company) is dissolved, and the resulting solution is charged into a polymerization flask. A reflux tube is attached to the polymerization flask, and the polymerization flask is heated on a water bath while injecting nitrogen under slow stirring up to 75° C., and retained at that temperature.

In 43 parts of ion exchange water, 9 parts of ammonium persulfate is dissolved, and the resulting solution is added dropwise to the polymerization flask containing the anionic surfactant aqueous solution for 20 minutes via a metering pump. Then the monomer emulsion A is added dropwise thereto for 200 minutes via a metering pump.

Subsequently, while stirring is continued, the polymerization flask is retained at 75° C. for 3 hours to complete polymerization of the first stage. As a result, a core resin particle dispersion (A1) precursor containing dispersed styrene resin particles that have a volume average particle diameter of 200 nm, a glass transition temperature of 53° C., and a weight average molecular weight of 34,000 is obtained.

Next, after the temperature is decreased to room temperature (25° C.), 240 parts of 2-ethylhexyl acrylate, 160 parts of n-butyl acrylate, and 1200 parts of ion exchange water are added to the polymerization flask containing the core resin particle dispersion (A1) precursor, and the resulting mixture is stirred slowly for 2 hours. Subsequently, while stirring is continued, the temperature is elevated to 70° C., and 4.5 parts of ammonium persulfate and 100 parts of ion exchange water are added dropwise thereto for 30 minutes via a metering pump. Subsequently, while stirring is continued, the temperature is retained thereat for 3 hours to complete polymerization. Through the above-described processes, a core resin particle dispersion (A1) is obtained. In the core resin particle dispersion (A1), composite resin particles having a volume average particle diameter of 220 nm, a weight average molecular weight of 132,000, and a number average molecular weight of 18,000 (molecular weight distribution: 7.33) are dispersed, and the solid content is adjusted to 30 mass % by adding ion exchange water.

The resin particles in the obtained core resin particle dispersion (A1) are dried, and the dried resin particles are embedded in an epoxy resin to prepare a sample. The sample is cut with a diamond knife to prepare a section of the resin particles. The section of the sample is stained in a ruthenium tetroxide steam, and is then observed with a transmission electron microscope. Sectional observation of the resin particles confirms that the resin particles have a structure in which multiple domains of a low-Tg (meth)acrylic acid ester resin are dispersed in a high-Tg styrene resin serving as a base material.

The glass transition temperature Tg behavior of the dried resin particles is analyzed with a differential scanning calorimeter (DSC) produced by Shimadzu Corporation from −150° C. to 100° C. As a result, glass transition due to the low-Tg (meth)acrylic acid ester resin is observed at −60° C. In addition, glass transition due to the high-Tg styrene resin is observed at 53° C. (difference in glass transition temperature: 113° C.).

Preparation of Core Resin Particle Dispersions (A2) and (A3)

Core resin particle dispersions (A2) and (A3) having a solid content adjusted to 30 mass % are obtained as with the core resin particle dispersion (A1) except that the amounts of the 2-ethylhexyl acrylate and butyl acrylate added after preparation of the core resin particle dispersion (A1) precursor are changed as indicated in Table 1.

The volume average particle diameter, the weight average molecular weight, the number average molecular weight, and the difference in glass transition temperature of the composite resin particles contained in the core resin particle dispersions (A2) and (A3) are indicated in Table 1.

TABLE 1

| Resin particle dispersion for core | 2-Ethylhexyl acrylate | n-Butyl acrylate | Volume average particle diameter (nm) | Weight average molecular weight | Number average molecular weight | Difference in glass transition temperature |
|---|---|---|---|---|---|---|
| (A1) | 242 parts | 162 parts | 220 | 130000 | 18000 | 113° C. |
| (A2) | 384 parts | 20 parts | 230 | 100000 | 12000 | 122° C. |
| (A3) | 81 parts | 323 parts | 235 | 150000 | 24000 | 110° C. |

Preparation of Shell Resin Particle Dispersion for Transparent Toner

Preparation of Shell Resin Particle Dispersion (B1)

Styrene: 450 parts n-Butyl acrylate: 135 parts

Acrylic acid: 12 parts

Dodecanethiol: 9 parts

The above-described components are mixed and dissolved to prepare a solution B.

Meanwhile, 10 parts of an anionic surfactant (DOWFAX 2A1 produced by The Dow Chemical Company) is dissolved in 250 parts of ion exchange water, the solution B is added to the resulting solution, and the resulting mixture is dispersed and emulsified in the flask (monomer emulsion B).

In 555 parts of ion exchange water, 1 part of the same anionic surfactant (DOWFAX 2A1 produced by The Dow Chemical Company) is dissolved, and the resulting solution is charged into a polymerization flask. A reflux tube is attached to the polymerization flask, and the polymerization flask is heated on a water bath while injecting nitrogen under slow stirring up to 75° C., and retained at that temperature.

In 43 parts of ion exchange water, 9 parts of ammonium persulfate is dissolved, and the resulting solution is added dropwise to the polymerization flask containing the anionic surfactant aqueous solution for 20 minutes via a metering pump. Then the monomer emulsion B is added dropwise thereto for 200 minutes via a metering pump.

Subsequently, while stirring is continued, the polymerization flask is retained at 76° C. for 3 hours to complete polymerization of the first stage. As a result, a shell resin particle dispersion (B1) containing dispersed styrene resin particles that have a volume average particle diameter of 190 nm, a glass transition temperature of 53° C., a weight average molecular weight of 32,000, and a number average molecular weight of 15,000 is obtained. The solid content thereof is adjusted to 30 mass % by adding ion exchange water.

Preparation of Releasing Agent Dispersion for Transparent Toner

Preparation of Releasing Agent Dispersion (1)

Fischer-Tropsch wax: 270 parts (trade name: FNP-0090 produced by Nippon Seiro Co., Ltd., melting temperature=90° C.)

Anionic surfactant: 1.0 parts (NEOGEN RK produced by DKS Co., Ltd.)

Ion exchange water: 400 parts

The above-described components are mixed, heated to 95° C., and dispersed in a homogenizer (ULTRA-TURRAX T50 produced by IKA Japan). The resulting dispersion is then dispersed in a Manton-Gaulin high-pressure homogenizer (produced by Gaulin Company) for 360 minutes to prepare a releasing agent dispersion (1) (solid content: 20 mass %) containing dispersed releasing agent particles having a volume-average particle size of 0.23 μm.

Preparation of Transparent Toner Particles

Preparation of Transparent Toner Particles (T1)

Core resin particle dispersion (A1): 840 parts

Releasing agent dispersion (1): 8 parts

Colloidal silica aqueous solution: 13 parts (SNOWTEX OS produced by Nissan Chemical Corporation)

Ion exchange water: 800 parts

Anionic surfactant: 1 part (DOWFAX 2A1 produced by The Dow Chemical Company)

The above-described core-forming material components are placed in a 3 L reactor equipped with a thermometer, a pH meter, and a stirrer, and the pH is adjusted to 3.0 by adding 1.0 mass % nitric acid at a temperature of 25° C. Then, while the resulting mixture is dispersed in a homogenizer (ULTRA-TURRAX T50 produced by IKA Japan) at 5,000 rpm, 4 parts of a 10 mass % aqueous polyaluminum chloride solution is added, and dispersing is further conducted for 6 minutes.

Subsequently, a stirrer and a heating mantle are attached to the reactor. While the number of rotation of the stirrer is adjusted so that the slurry is thoroughly stirred, the temperature is elevated at a temperature elevation rate of 0.2° C./minute up to a temperature of 40° C. and then at 0.05° C./minute beyond 40° C. The particle diameter is measured every 10 minutes with COULTER MULTISIZER II (aperture diameter: 50 μm, produced by Coulter Inc.). The temperature is retained when the volume-average particle diameter reached 7.8 μm, and 150 parts of the shell resin particle dispersion (B1), which is a shell-forming material, is added thereto for 5 minutes. After this condition is retained for 30 minutes, the pH is adjusted to 6.0 by using a 1 mass % aqueous sodium hydroxide solution. Subsequently, while the same adjustment is performed every 5° C. to adjust the pH to 6.0, the temperature is elevated at a temperature elevation rate of 1° C./minute up to 90° C., and the temperature is retained at 96° C. The particle shape and the surface property are observed with an optical microscope and a scanning electron microscope (FE-SEM), and coalescence of particles is confirmed 2.0 hours after starting to retain the temperature at 96° C. Thus, the reactor is cooled with cooling water for 5 minutes to 30° C.

The cooled slurry is passed through a nylon mesh having an aperture of 30 μm to remove coarse particles, and the toner slurry that has passed through the mesh is filtered at a reduced pressure by using an aspirator. The toner remaining on the paper filter is manually pulverized as finely as possible and is added to ion exchange water in an amount ten times the amount of the toner at a temperature of 30° C. The resulting mixture is stirred and mixed for 30 minutes. Subsequently, the toner remaining on the paper filter after filtration at a reduced pressure in an aspirator is pulverized manually as finely as possible and is added to ion exchange water in an amount ten times the amount of the toner at a temperature of 30° C. The resulting mixture is stirred and mixed for 30 minutes and is again filtered at a reduced pressure with an aspirator. The electrical conductivity of the filtrate is measured. This operation is repeated until the electrical conductivity of the filtrate is 10 μS/cm or less so as to wash the toner. The washed toner is finely pulverized in a wet-dry-type particle sizer (Comil) and then vacuum-dried in a dryer at 25° C. for 36 hours. As a result, transparent toner particles (T1) are obtained. The obtained transparent toner particles (T1) have a volume average particle diameter of 8.5 μm, a weight average molecular weight of 126,000, and a number average molecular weight of 17,000 (molecular weight distribution: 7.41). The temperature T3 at which the transparent toner particles (T1) exhibit a viscosity of 10000 Pa·s at a pressure of 4 MPa is measured and is found to be 123° C. The temperature difference (T1−T3) is 17° C., and tan δ2 is 1.2.

Sections of the transparent toner particles (T1) are observed with a scanning electron microscope (SEM). A sea-island structure is observed. The transparent toner particles (T1) have a core in which island phases are present, and a shell layer in which no island phases are present. The sea phase contains a styrene resin, and the island phases contains a (meth)acrylic acid ester resin.

The average size of the island phases is determined by the aforementioned measuring method. The average size of the island phases is indicated in Table 2.

Preparation of Transparent Toner Particles (T2) to (T5)

Transparent toner particles (T2) to (T5) are each prepared as with the transparent toner particles (T1) except that the core resin particle dispersion indicated in Table 2 is used instead of the core resin particle dispersion (A1) and that the volume-average particle diameter before adding 150 parts of shell resin particle dispersion (B1) for 5 minutes is changed.

The volume average particle diameter, the weight average molecular weight, the number average molecular weight, tan δ2, the temperature T3, the temperature difference (T1−T3), and the average size of the island phases of the transparent toner particles (T2) to (T5) are indicated in Table 2.

TABLE 2

| Transparent toner particles | Resin particle dispersion for core | Volume average particle diameter (μm) | Weight average molecular weight ($10^4$) | Number average molecular weight ($10^4$) | tan δ2 | T3 | T1-T3 | Average size of island phases (nm) |
|---|---|---|---|---|---|---|---|---|
| (T1) | (A1) | 8.5 | 12.6 | 1.7 | 1.2 | 123° C. | 17° C. | 350 |
| (T2) | (A1) | 11.0 | 12.6 | 1.7 | 1.2 | 124° C. | 17° C. | 330 |
| (T3) | (A1) | 14.0 | 12.6 | 1.7 | 1.2 | 123° C. | 17° C. | 370 |
| (T4) | (A2) | 11.0 | 9.5 | 1.1 | 1.5 | 108° C. | 12° C. | 270 |
| (T5) | (A3) | 11.0 | 14.5 | 2.2 | 1.0 | 125° C. | 13° C. | 290 |

Preparation of Externally Added Transparent Toner

Preparation of Externally Added Transparent Toner (T1)

To 100 parts of the obtained transparent toner particles (T1), 1.5 parts of hydrophobic silica (RY50 produced by Nippon Aerosil Co., Ltd.) is added, and the resulting mixture is mixed in a sample mill at 13000 rpm for 30 seconds. The mixture is then screened through a vibrating screen having an aperture of 45 μm. As a result, an externally added transparent toner (T1) is prepared. The volume-average particle diameter of the obtained externally added transparent toner (T1) is 8.6 μm.

T1 and T2 of the externally added transparent toner (T1) measured by the method described above satisfy formula 3, "10° C.≤T1−T2".

Preparation of Externally Added Transparent Toners (T2) to (T5)

Externally added transparent toners (T2) to (T5) are prepared as with the externally added transparent toner (T1) except that transparent toner particles (T2) to (T5) are respectively used instead of the transparent toner particles (T1).

T1 and T2 of the externally added transparent toners (T2) to (T5) measured by the method described above also satisfy formula 3, "10° C.≤T1−T2".

Preparation of Transparent Electrostatic Charge Image Developer

Preparation of Developer (T1)

A developer (T1), which is a transparent electrostatic charge image developer, is prepared by mixing 8 parts of the externally added transparent toner (T1) and 100 parts of the carrier (1) described below in a V blender.

Preparation of Carrier (1)

A coating layer-forming solution containing dispersed zinc oxide is prepared by mixing 14 parts of toluene, 2 parts of a styrene-methyl methacrylate copolymer (mass ratio=80/20, weight-average molecular weight: 70000), and 0.6 parts of zinc oxide (MZ500 produced by Titan Kogyo, Ltd.) and stirring the resulting mixture in a stirrer for 10 minutes. Next, the coating layer-forming solution and 100 parts of ferrite particles (volume average particle diameter: 38 μm) are placed in a vacuum deaerator-type kneader, and stirred at 60° C. for 30 minutes. Then, the pressure is reduced to deaerate while the mixture is heated and dried. As a result, a carrier is obtained.

Preparation of Developers (T2) to (T5)

Developers (T2) to (T5) are prepared as with the developer (T1) except that the externally added transparent toners (T2) to (T5) are respectively used instead of the externally added transparent toner (T1).

Preparation of Dispersions for Color Toners

Crystalline Polyester Resin Dispersion (A)

To a heated and dried three-necked flask, 100 parts of a monomer component composed of 100 mol % of dimethyl sebacate and 100 mol % of nonanediol and 0.3 parts of dibutyl tin oxide serving as a catalyst are placed, and then air inside the flask is replaced with nitrogen gas to create an inert atmosphere by a depressurizing operation. The resulting g mixture is mechanically stirred at 180° C. for 4 hours to conduct stirring and refluxing.

Subsequently, at a reduced pressure, the temperature is gradually elevated to 230° C., the mixture is stirred for 2 hours, and, after the mixture has turned viscous, the mixture is air-cooled to terminate the reaction. As a result, a crystalline polyester resin (1) is synthesized. The weight average molecular weight (Mw) of the obtained crystalline polyester resin (1) as determined by molecular weight measurement (polystyrene equivalent) by gel permeation chromatography is 15300, the number average molecular weight (Mn) is 3800, and the acid value is 13.5 mgKOH/g.

The melting point (Tm) of the crystalline polyester resin (1) is measured with a differential scanning calorimeter (DSC). The crystalline polyester resin (1) exhibits a clear endothermic peak, and the endothermic peak temperature is 77.2° C.

Next, a resin particle dispersion is prepared by using the crystalline polyester resin (1).

Crystalline polyester resin (1): 90 parts

Ionic surfactant (NEOGEN RK produced by DKS Co., Ltd.): 1.8 parts

Ion exchange water: 210 parts

The above-described components are mixed and heated to 100° C. The resulting mixture is dispersed in a homogenizer (ULTRA-TURRAX T50 produced by IKA Japan), and the resulting dispersion is then dispersed in a pressure-discharge-type Gaulin homogenizer while being heated to 110° C. for 1 hour. As a result, a crystalline polyester resin dispersion (A) having a volume average particle diameter of 210 nm and a solid content of 30 mass % is obtained.

Amorphous Polyester Resin Dispersion (A)

Bisphenol A propylene oxide adduct: 80 mol %

Bisphenol A ethylene oxide 2-mol adduct: 20 mol %

Terephthalic acid: 60 mol %

Fumaric acid: 20 mol %

Dodecenylsuccinic anhydride: 20 mol %

The monomer components having the ratios described above are charged into a 5 L flask equipped with a stirrer, a nitrogen inlet tube, a temperature sensor, and a distillation column, and the temperature is elevated to 190° C. in 1 hour. After confirming that the reaction system is thoroughly stirred, 1.2 parts of dibutyl tin oxide is added relative to 100 parts of the monomer components. While distilling away generated water, the temperature is increased from the aforementioned temperature to 240° C. in 6 hours, a dehydration condensation reaction is continued further for 2 hours at 240° C., and, as a result, an amorphous polyester resin (1), which is an amorphous polyester resin having a glass transition temperature of 63° C., an acid value of 10.5 mgKOH/g, a weight average molecular weight of 17000, and a number average molecular weight of 4200, is obtained.

Next, a resin particle dispersion is prepared by using the obtained amorphous polyester resin (1).

Amorphous polyester resin (1): 100 parts

Ethyl acetate: 50 parts

Into a 5 L separable flask, ethyl acetate is placed, and then the above-described resin component is slowly added while the mixture is being stirred with a three-one motor to achieve complete dissolution and to thereby obtain an oil phase. To the oil phase that is being stirred, a total of 2 parts of a 10 mass % aqueous ammonia solution is added slowly using a dropper, and 230 parts of ion exchange water is further added thereto dropwise at a speed of 10 ml/min so as to induce inverse phase emulsification. Furthermore, the solvent is removed while reducing the pressure with an evaporator, and an amorphous polyester resin dispersion (A) is obtained as a result. The amorphous polyester resin particles in this dispersion have a volume average particle diameter of 120 nm, and the solid concentration is 30 mass %.

Amorphous Polyester Resin Dispersion (B)

Bisphenol A propylene oxide adduct: 50 mol %

Bisphenol A ethylene oxide 2-mol adduct: 50 mol %

Trimellitic anhydride: 5 mol %

Terephthalic acid: 85 mol %

Dodecenylsuccinic anhydride: 10 mol %

Of the monomer components having the above-described ratios, the monomers other than trimellitic anhydride are used to perform a reaction according to the synthesis of the above-described amorphous polyester resin (1) until the softening point reaches 110° C. That is, the above-described monomer components (excluding trimellitic anhydride) having the ratios described above are charged into a 5 L flask equipped with a stirrer, a nitrogen inlet tube, a temperature sensor, and a distillation column, and the temperature is elevated to 190° C. in 1 hour. After confirming that the reaction system is thoroughly stirred, 1.2 parts of dibutyl tin oxide is added to 100 parts of the monomer components, and while distilling away generated water, the temperature is increased from the aforementioned temperature to 240° C. in 6 hours. Then, a dehydration condensation reaction is continued further for 2 hours at 240° C.

Then the temperature is decreased to 190° C., 5 mol % of trimellitic anhydride is slowly added, and the reaction is continued for 2 hours at the same temperature. As a result, an amorphous polyester resin (2), which is an amorphous polyester resin having a glass transition temperature of 63° C., an acid value of 15.3 mgKOH/g, a weight average molecular weight of 49000, and a number average molecular weight of 7000, is obtained.

Next, a resin particle dispersion is prepared by using the amorphous polyester resin (2).

An amorphous polyester resin dispersion (B) is obtained as with the preparation of the amorphous polyester resin dispersion (A) except that the amorphous polyester resin (1) used in preparing the amorphous polyester resin dispersion (A) is changed to the amorphous polyester resin (2). The amorphous polyester resin particles in this dispersion have a volume average particle diameter of 220 nm, and the solid concentration is 30 mass %.

Coloring Agent Particle Dispersion 1

Carbon black (Regal 330 produced by Cabot Corporation): 50 parts

Anionic surfactant (NEWREX R produced by NOF CORPORATION): 2 parts

Ion exchange water: 198 parts

The above-described components are mixed, pre-dispersed in a homogenizer (ULTRA-TURRAX T50 produced by IKA Japan) for 10 minutes, and then dispersed in ALTIMIZER (counter collision-type wet-type disintegrator produced by SUGINO MACHINE LIMITED) at a pressure of 245 MPa for 15 minutes. As a result, a coloring agent particle dispersion 1 that contains coloring agent particles having a volume-average particle diameter of 354 nm and has a solid content of 20.0 mass % is obtained.

Coloring Agent Particle Dispersion 2

Blue pigment (copper phthalocyanine C.I. Pigment blue 15:3, produced by Dainichiseika Color & Chemicals Mfg. Co., Ltd.): 50 parts Ionic surfactant (NEOGEN RK produced by DKS Co., Ltd.): 5 parts Ion exchange water: 195 parts The above-described components are mixed, dispersed in a homogenizer (ULTRA-TURRAX T50 produced by IKA Japan) for 10 minutes, and then dispersed in ALTIMIZER (counter collision-type wet-type disintegrator produced by SUGINO MACHINE LIMITED) at a pressure of 245 MPa for 15 minutes. As a result, a coloring agent particle dispersion 2 that contain coloring agent particles having a volume average particle diameter of 462 nm and that have a solid content of 20.0 mass % is obtained.

Coloring Agent Particle Dispersion 3

Magenta pigment (C.I. Pigment Red 122): 80 parts

Anionic surfactant (NEOGEN SC produced by DKS Co., Ltd.): 8 parts

Ion exchange water: 200 parts

The above-described components are mixed and dissolved, the resulting mixture is dispersed in a homogenizer (ULTRA-TURRAX T50 produced by IKA Japan) for 10 minutes, and then the resulting dispersion is exposed to 28 kHz ultrasonic waves for 10 minutes by using an ultrasonic wave disperser. As a result, a coloring agent particle dispersion 3 that contains coloring agent particles having a volume-average particle diameter of 132 nm and that have a solid content of 29.0 mass % is obtained.

Coloring Agent Particle Dispersion 4

Yellow pigment (5GX 03 produced by Clariant): 80 parts

Anionic surfactant (NEOGEN SC produced by DKS Co., Ltd.): 8 parts

Ion exchange water: 200 parts

The above-described components are mixed and dissolved, the resulting mixture is dispersed in a homogenizer (ULTRA-TURRAX T50 produced by IKA Japan) for 10 minutes, and then the resulting dispersion is exposed to 28 kHz ultrasonic waves for 20 minutes by using an ultrasonic wave disperser. As a result, a coloring agent particle dispersion 4 that contains coloring agent particles having a volume-average particle diameter of 108 nm and that has a solid content of 29.0 mass % is obtained.

Releasing Agent Particle Dispersion 2

Olefin wax (melting point: 88° C.): 90 parts

Ionic surfactant (NEOGEN RK produced by DKS Co., Ltd.): 1.8 parts

Ion exchange water: 210 parts

The above-described materials are mixed and heated to 100° C. The resulting mixture is dispersed in a homogenizer (ULTRA-TURRAX T50 produced by IKA Japan), and the resulting dispersion is then heated in a pressure-discharge-type Gaulin homogenizer to 110° C. and dispersed for 1 hour. As a result, a releasing agent particle dispersion 2 that contains releasing agent particles having a volume average particle diameter of 180 nm and that has a solid content of 30 mass % is obtained.

Preparation of Electrostatic Charge Image Developers

Preparation of Black Toner Particles 1

Amorphous polyester resin dispersion (A): 166 parts

Crystalline polyester resin dispersion (A): 50 parts

Coloring agent particle dispersion 1: 25 parts

Releasing agent particle dispersion 2: 40 parts

The above-described materials are mixed and dispersed in a stainless steel flask using a homogenizer (ULTRA-TURRAX T50). Next, 0.20 parts of polyaluminum chloride is added thereto, and the dispersing operation is continued in the ULTRA-TURRAX T50. The resulting mixture is heated to 48° C. while the flask is stirred on a heating oil bath. After 48° C. is retained for 60 minutes, 60 parts of the amorphous polyester resin dispersion (A) is gradually added thereto. Subsequently, the pH of the system is adjusted to 8.0 by using a 0.5 mol/l aqueous sodium hydroxide solution, the stainless steel flask is sealed, and heating performed to 90° C. while continuing stirring by using a magnetic seal. Then this temperature is retained for 3 hours.

Upon completion of the reaction, the mixture is cooled, filtered, and washed with ion exchange water. Then solid-liquid separation is performed by Nutsche suction filtration. The resulting product is re-dispersed in 1 L of ion exchange water at 40° C., and stirred and washed at 300 rpm for 15 minutes. This operation is repeated five more times. After the pH of the filtrate has reached 7.5 and the electrical conductivity has reached 7.0 μS/cm, solid-liquid separation is performed by Nutsche suction filtration using a No. 5A paper filter. Subsequently, vacuum drying is continued for 12 hours, and black toner particles 1 are obtained as a result.

The particle diameter of the black toner particles 1 is measured with Multisizer II. The volume average particle diameter D50 is 6.4 μm, the volume particle size distribution index GSDv is 1.21, and tan δ1 at 100° C. is 3.7.

Preparation of Black Toner 1

One hundred parts of the black toner particles 1 and 1.3 parts of hydrophobic silica having an average particle diameter of 30 nm (NY50 produced by Nippon Aerosil Co., Ltd.) are mixed, and the mixture is blended for 10 minutes in a HENSCHEL mixer at a peripheral speed of 32 m/s. Subsequently, coarse particles are removed by using a 45 μm sieve to obtain a black toner 1.

Preparation of Carrier (2)

Ferrite particles (volume average particle diameter: 50 μm, volume resistivity: $10^8$ Ωcm): 100 parts Toluene: 14 parts Perfluorooctyl ethyl acrylate/methyl methacrylate copolymer (copolymerization ratio: 40/60, Mw: 50,000): 1.6 parts Carbon black (VXC-72 produced by Cabot Corporation): 0.12 parts Crosslinked melamine resin particles (number average particle diameter: 0.3 μm): 0.3 parts Of the components described above, the components other than the ferrite particles are mixed and dispersed by a stirrer for 10 minutes to prepare a coating film-forming solution. This coating film-forming solution and the ferrite particles are placed in a vacuum deaerator-type kneader and stirred for 30 minutes at 60° C. Then, the pressure is decreased, toluene is distilled away, and resin coating films are formed on the ferrite particle surfaces. As a result, a carrier (2) is produced.

Preparation of Developer C1

Ninety-four parts of the carrier and 6 parts of the black toner 1 are mixed and stirred for 20 minutes in a V-blender at 40 rpm, and sieved through a 177 μm sieve to prepare a developer C1.

Preparation of Developer C2

Cyan toner particles 1 are obtained as with the preparation of the black toner particles 1 except that the coloring agent particle dispersion 1 used in preparing the black toner particles 1 is changed to 20 parts of the coloring agent particle dispersion 2. The volume average particle diameter D50, the volume particle size distribution index, and tan δ1 of the obtained toner particles are indicated in Table 3.

A developer C2 is obtained as with the developer C1 except that cyan toner particles 1 are used instead of the black toner particles 1.

Preparation of Developer C3

Magenta toner particles 1 are obtained as with the preparation of the black toner particles 1 except that the coloring agent particle dispersion 1 used in preparing the black toner particles 1 is changed to 25 parts of the coloring agent particle dispersion 3. The volume average particle diameter D50, the volume particle size distribution index, and tan δ1 of the obtained toner particles are indicated in Table 3.

A developer C3 is obtained as with the developer C1 except that magenta toner particles 1 are used instead of the black toner particles 1.

Preparation of Developer C4

Yellow toner particles 1 are obtained as with the preparation of the black toner particles 1 except that the coloring agent particle dispersion 1 used in preparing the black toner particles 1 is changed to 25 parts of the coloring agent particle dispersion 4. The volume average particle diameter D50, the volume particle size distribution index, and tan δ1 of the obtained toner particles are indicated in Table 3.

A developer C4 is obtained as with the developer C1 except that yellow toner particles 1 are used instead of the black toner particles 1.

Preparation of Developers (C5) to (C8)

Black toner particles 2, cyan toner particles 2, magenta toner particles 2, and yellow toner particles 2 are prepared as with the black toner particles 1, the cyan toner particles 1, the magenta toner particles 1, and the yellow toner particles 1, respectively, except that the amorphous polyester resin dispersion used in the early stage of the toner particle preparation is changed from 166 parts of the amorphous polyester resin dispersion (A) to 80 parts of the amorphous polyester resin dispersion (A) and 80 parts of the amorphous polyester resin dispersion (B) and that the amorphous polyester resin dispersion to be added later is changed from 60 parts of the amorphous polyester resin dispersion (A) to 30 parts of the amorphous polyester resin dispersion (A) and 30 parts of the amorphous polyester resin dispersion (B). The volume-average particle diameter D50, the volume particle size distribution index, and tan δ1 of the obtained toner particles are indicated in Table 3.

Developers C5 to C8 are obtained as with the developers C1 to C4 except that the black toner particles 2, the cyan toner particles 2, the magenta toner particles 2, and the yellow toner particles 2 are used instead of the black toner particles 1, the cyan toner particles 1, the magenta toner particles 1, and the yellow toner particles 1. Preparation of developers (C9) to (C12)

Black toner particles 3, cyan toner particles 3, magenta toner particles 3, and yellow toner particles 3 are prepared as with the black toner particles 1, the cyan toner particles 1, the magenta toner particles 1, and the yellow toner particles 1, respectively, except that the amorphous polyester resin dispersion used in the early stage of the toner particle preparation is changed from 166 parts of the amorphous polyester resin dispersion (A) to 166 parts of the amorphous polyester resin dispersion (B) and that the amorphous polyester resin dispersion to be added later is changed from 60 parts of the amorphous polyester resin dispersion (A) to 60 parts of the amorphous polyester resin dispersion (B). The volume average particle diameter D50, the volume particle size distribution index, and tan δ1 of the obtained toner particles are indicated in Table 3.

Developers C9 to C12 are obtained as with the developers C1 to C4 except that the black toner particles 3, the cyan toner particles 3, the magenta toner particles 3, and the yellow toner particles 3 are used instead of the black toner particles 1, the cyan toner particles 1, the magenta toner particles 1, and the yellow toner particles 1. Preparation of developers (C13) to (C16)

Black toner particles 4, cyan toner particles 4, magenta toner particles 4, and yellow toner particles 4 are prepared as with the black toner particles 1, the cyan toner particles 1, the magenta toner particles 1, and the yellow toner particles 1, respectively, except that the amount of the crystalline polyester resin dispersion (A) used in the early stage of the toner particle preparation is changed from 50 parts to 130 parts. The volume average particle diameter D50, the volume particle size distribution index, and tan δ1 of the obtained toner particles are indicated in Table 4.

Developers C13 to C16 are obtained as with the developers C1 to C4 except that the black toner particles 4, the cyan toner particles 4, the magenta toner particles 4, and the yellow toner particles 4 are used instead of the black toner particles 1, the cyan toner particles 1, the magenta toner particles 1, and the yellow toner particles 1. Preparation of developers (C17) to (C20)

Black toner particles 5, cyan toner particles 5, magenta toner particles 5, and yellow toner particles 5 are prepared as with the black toner particles 3, the cyan toner particles 3, the magenta toner particles 3, and the yellow toner particles 3, respectively, except that the amount of the crystalline polyester resin dispersion (A) used in the early stage of the toner particle preparation is changed from 50 parts to 20 parts. The volume average particle diameter D50, the volume particle size distribution index, and tan δ1 of the obtained toner particles are indicated in Table 4.

Developers C17 to C20 are obtained as with the developers C9 to C12 except that the black toner particles 5, the cyan toner particles 5, the magenta toner particles 5, and the yellow toner particles 5 are used instead of the black toner particles 3, the cyan toner particles 3, the magenta toner particles 3, and the yellow toner particles 3.

TABLE 3

| Developer | Toner particles | Coloring agent particle dispersion | Crystalline polyester resin dispersion (A) | Amorphous polyester resin dispersion (A) | Amorphous polyester resin dispersion (B) | Volume average particle diameter (μm) | Volume particle size distribution index | tanδ1 |
|---|---|---|---|---|---|---|---|---|
| C1 | Black toner particles 1 | 1: 25 parts | 50 parts | 166 parts + 60 parts | — | 6.4 | 1.21 | 3.5 |
| C2 | Cyan toner particles 1 | 2: 20 parts | 50 parts | 166 parts + 60 parts | — | 6.2 | 1.21 | 3.3 |
| C3 | Magenta toner particles 1 | 3: 25 parts | 50 parts | 166 parts + 60 parts | — | 6.1 | 1.22 | 3.4 |
| C4 | Yellow toner particles 1 | 3: 25 parts | 50 parts | 166 parts + 60 parts | — | 6.1 | 1.22 | 3.3 |
| C5 | Black toner particles 2 | 1: 25 parts | 50 parts | 80 parts + 30 parts | 80 parts + 30 parts | 6.0 | 1.21 | 2.2 |
| C6 | Cyan toner particles 2 | 2: 20 parts | 50 parts | 80 parts + 30 parts | 80 parts + 30 parts | 6.2 | 1.21 | 2.3 |
| C7 | Magenta toner particles 2 | 3: 25 parts | 50 parts | 80 parts + 30 parts | 80 parts + 30 parts | 6.0 | 1.22 | 2.3 |
| C8 | Yellow toner particles 2 | 3: 25 parts | 50 parts | 80 parts + 30 parts | 80 parts + 30 parts | 6.2 | 1.21 | 2.4 |
| C9 | Black toner particles 3 | 1: 25 parts | 50 parts | — | 166 parts + 60 parts | 6.0 | 1.21 | 1.5 |
| C10 | Cyan toner particles 3 | 2: 20 parts | 50 parts | — | 166 parts + 60 parts | 6.0 | 1.21 | 1.7 |
| C11 | Magenta toner particles 3 | 3: 25 parts | 50 parts | — | 166 parts + 60 parts | 6.0 | 1.21 | 1.6 |
| C12 | Yellow toner particles 3 | 3: 25 parts | 50 parts | — | 166 parts + 60 parts | 6.0 | 1.21 | 1.7 |

TABLE 4

| Developer | Toner particles | Coloring agent particle dispersion | Crystalline polyester resin dispersion (A) | Amorphous polyester resin dispersion (A) | Amorphous polyester resin dispersion (B) | Volume average particle diameter (μm) | Volume particle size distribution index | tanδ1 |
|---|---|---|---|---|---|---|---|---|
| C13 | Black toner particles 4 | 1: 25 parts | 130 parts | 166 parts + 60 parts | — | 6.0 | 1.21 | 4.1 |
| C14 | Cyan toner particles 4 | 2: 20 parts | 130 parts | 166 parts + 60 parts | — | 6.2 | 1.21 | 4.2 |

TABLE 4-continued

| Developer | Toner particles | Coloring agent particle dispersion | Crystalline polyester resin dispersion (A) | Amorphous polyester resin dispersion (A) | Amorphous polyester resin dispersion (B) | Volume average particle diameter (μm) | Volume particle size distribution index | tanδ1 |
|---|---|---|---|---|---|---|---|---|
| C15 | Magenta toner particles 4 | 3: 25 parts | 130 parts | 166 parts + 60 parts | — | 6.1 | 1.21 | 4.1 |
| C16 | Yellow toner particles 4 | 3: 25 parts | 130 parts | 166 parts + 60 parts | — | 6.3 | 1.22 | 4.2 |
| C17 | Black toner particles 5 | 1: 25 parts | 20 parts | — | 166 parts + 60 parts | 6.3 | 1.22 | 1.3 |
| C18 | Cyan toner particles 5 | 2: 20 parts | 20 parts | — | 166 parts + 60 parts | 6.5 | 1.22 | 1.4 |
| C19 | Magenta toner particles 5 | 3: 25 parts | 20 parts | — | 166 parts + 60 parts | 6.2 | 1.22 | 1.4 |
| C20 | Yellow toner particles 5 | 3: 25 parts | 20 parts | — | 166 parts + 60 parts | 6.2 | 1.22 | 1.4 |

Evaluation

The developers indicated in Table 5 are loaded to the cyan, magenta, yellow, and black developing devices and the fifth developing device of a modified model of COLOR1000 PRESS produced by Fuji Xerox Co., Ltd. Recording sheets (OK Prince high-grade paper produced by Oji Paper Co., Ltd.) are set, and an image (area density: 30%) having both characters and photographic images is formed at a fixing temperature of 170° C., a fixing pressure of 4.0 kg/cm$^2$, and a transparent toner loaded amount of 3 g/m$^2$ to perform fixing. The order of placing toner images are, from the side close to the recording sheet, color toner images and a transparent toner layer.

Press Bondability

Next, the paper is folded so that the surfaces of the flaps with the image fixed thereon come into contact with each other, and is press-bonded at a pressure of 90 MPa by using a modified model of a press bonding sealer, PRESSELE LEADA (produced by Toppan Forms Co., Ltd.), to prepare a press-bonded printed material (1).

The press-bonded printed material (1) is cut in the long side direction to prepare a rectangular sample having a width of 15 mm, and a peel force is measured by a known method (90 degrees peel method). The results are indicated in Table 5. The larger the peel force, the better the press bondability.

Offset

Next, 1,000 printouts (in other words, formation and fixing of color toner images and a transparent toner layer) are continuously made in an environment of 20° C. and 55% RH, and then the fixing members are observed visually to check the toner contamination so as to evaluate the offset according to the following standard. The results are indicated in Table 5.

A: Toner contamination is not found on the fixing members.

B: Slight transparent toner attachment on the surfaces of the fixing members is found, but the level thereof is acceptable.

C: Attachment of color toners on the surfaces of the fixing members is found.

TABLE 5

| | Developer | | | | | | | | |
|---|---|---|---|---|---|---|---|---|---|
| | Position of black | Position of cyan | Position of magenta | Position of yellow | Fifth developing device | tanδ1 | tanδ1/tanδ2 | Offset | Peel force (N) |
| Example A1 | C1 | C2 | C3 | C4 | (T1) | 3.3 to 3.5 | 2.8 to 2.9 | A | 0.7 |
| Example A2 | C5 | C6 | C7 | C8 | (T2) | 2.2 to 2.4 | 1.8 to 2.0 | A | 0.9 |
| Example A3 | C9 | C10 | C11 | C12 | (T3) | 1.5 to 1.7 | 1.3 to 1.4 | A | 1.3 |
| Example A4 | C5 | C6 | C7 | C8 | (T4) | 2.2 to 2.4 | 1.5 to 1.6 | B | 0.8 |
| Example A5 | C5 | C6 | C7 | C8 | (T5) | 2.2 to 2.4 | 2.2 to 2.4 | A | 0.7 |
| Comparative Example A1 | C1 | C2 | C3 | C4 | (T5) | 3.3 to 3.5 | 3.3 to 3.5 | A | 0.3 |
| Comparative Example A2 | C9 | C10 | C11 | C12 | (T4) | 1.5 to 1.7 | 1.0 to 1.1 | C | 0.8 |
| Comparative Example A3 | C13 | C14 | C15 | C16 | (T1) | 4.1 to 4.2 | 3.4 to 3.5 | A | 0.2 |

The results show that, compared to Comparative Examples, Examples achieve both suppression of offset and press bondability.

Reference Example B

Preparation of Dispersion Containing Styrene Resin Particles

Preparation of Styrene Resin Particle Dispersion (St1)

Styrene: 390 parts
n-Butyl acrylate: 100 parts
Acrylic acid: 10 parts
Dodecanethiol: 7.5 parts The above-described materials are mixed and dissolved to prepare a monomer solution.

In 205 parts of ion exchange water, 8 parts of an anionic surfactant (DOWFAX 2A1 produced by The Dow Chemical Company) is dissolved, and the above-described monomer solution is added to the resulting solution. The resulting mixture is dispersed and emulsified to obtain an emulsion.

In 462 parts of ion exchange water, 2.2 part of an anionic surfactant (DOWFAX 2A1 produced by The Dow Chemical Company) is dissolved. The resulting solution is charged into a polymerization flask equipped with a stirrer, a thermometer, a reflux cooling tube, and a nitrogen inlet tube and is heated to 73° C. under stirring, and the temperature is retained thereat.

In 21 parts of ion exchange water, 3 parts of ammonium persulfate is dissolved, and the resulting solution is added dropwise to the polymerization flask for 15 minutes via a metering pump. Then, the emulsion is added dropwise thereto for 160 minutes via a metering pump.

Subsequently, while slow stirring is continued, the polymerization flask is retained at 75° C. for 3 hours, and then the temperature is returned to room temperature.

As a result, a styrene resin particle dispersion (Stl) that contains styrene resin particles having a volume average particle diameter (D50v) of 174 nm, a weight average molecular weight of 49 k as determined by GPC (UV detection), and a glass transition temperature of 54° C., and that has a solid content of 42% is obtained.

The styrene resin particle dispersion (St1) is dried to obtain styrene resin particles, and the thermal behavior in the temperature range of −100° C. to 100° C. is analyzed with a differential scanning calorimeter (DSC-60A produced by Shimadzu Corporation). One glass transition temperature is observed. Table 6 indicates the glass transition temperature.

Preparation of Styrene Resin Particle Dispersions (St2) to (St13)

Styrene resin particle dispersions (St2) to (St13) are prepared as with the preparation of the styrene resin particle dispersion (St1) except that the monomers are changed as indicated in Table 6.

In Table 6, the monomers are abbreviated as follows.

Styrene: St, n-butyl acrylate: BA, 2-ethylhexyl acrylate: 2EHA, ethyl acrylate: EA, 4-hydroxybutyl acrylate: 4HBA, acrylic acid: AA, methacrylic acid: MAA, 2-carboxyethyl acrylate: CEA

TABLE 6

| Styrene resin particle dispersion | | | | | | | | | | | |
|---|---|---|---|---|---|---|---|---|---|---|---|
| | Polymerization components (mass ratio) | | | | | | | | D50v of resin particles | Mw (k) | Tg |
| No. | St | BA | 2EHA | EA | 4HBA | AA | MAA | CEA | nm | — | ° C. |
| St1 | 78 | 20 | 0 | 0 | 0 | 2 | 0 | 0 | 174 | 49 | 54 |
| St2 | 88 | 10 | 0 | 0 | 0 | 2 | 0 | 0 | 170 | 50 | 76 |
| St3 | 83 | 15 | 0 | 0 | 0 | 2 | 0 | 0 | 172 | 52 | 65 |
| St4 | 78 | 20 | 0 | 0 | 0 | 0 | 2 | 0 | 177 | 48 | 57 |
| St5 | 80 | 15 | 0 | 0 | 5 | 0 | 0 | 0 | 172 | 46 | 55 |
| St6 | 80 | 15 | 5 | 0 | 0 | 0 | 0 | 0 | 174 | 51 | 54 |
| St7 | 80 | 20 | 0 | 0 | 0 | 0 | 0 | 0 | 169 | 50 | 54 |
| St8 | 77 | 20 | 0 | 0 | 0 | 0 | 0 | 3 | 168 | 48 | 54 |
| St9 | 72 | 26 | 0 | 0 | 0 | 2 | 0 | 0 | 172 | 55 | 43 |
| St10 | 68 | 30 | 0 | 0 | 0 | 2 | 0 | 0 | 173 | 53 | 35 |
| St11 | 80 | 0 | 20 | 0 | 0 | 0 | 0 | 0 | 171 | 52 | 56 |
| St12 | 78 | 0 | 20 | 0 | 0 | 2 | 0 | 0 | 167 | 49 | 56 |
| St13 | 63 | 0 | 0 | 35 | 0 | 2 | 0 | 0 | 169 | 51 | 54 |

Preparation of Dispersion Containing Composite Resin Particles

Preparation of composite resin particle dispersion (M1)

Styrene resin particle dispersion (St1): 1190 parts (solid content: 500 parts)
2-Ethylhexyl acrylate: 250 parts
n-Butyl acrylate: 250 parts
Ion exchange water: 982 parts The above-described materials are charged into a polymerization flask, stirred at 25° C. for 1 hour, and heated to 70° C.

In 75 parts of ion exchange water, 2.5 parts of ammonium persulfate is dissolved, and the resulting solution is added dropwise to the aforementioned polymerization flask for 60 minutes via a metering pump.

Subsequently, while slow stirring is continued, the polymerization flask is retained at 70° C. for 3 hours, and then the temperature is returned to room temperature.

As a result, a composite resin particle dispersion (M1) that contains composite resin particles having a volume average particle diameter (D50v) of 219 nm and a weight average molecular weight of 219 k as determined by GPC (UV detection) and that has a solid content of 32% is obtained.

The composite resin particle dispersion (M1) is dried to obtain composite resin particles, and the thermal behavior in the temperature range of −150° C. to 100° C. is analyzed with a differential scanning calorimeter (DSC-60A produced by Shimadzu Corporation). Two glass transition temperatures are observed. Table 7 indicates the glass transition temperatures.

Preparation of Composite Resin Particle Dispersions (M2) to (M21) and (cM1) to (cM3)

Composite resin particle dispersions (M2) to (M21) and (cM1) to (cM3) are prepared as with the preparation of the composite resin particle dispersion (M1) except that the styrene resin particle dispersion (St1) is changed as described in Table 7 or that the polymerization components of the (meth)acrylic acid ester resin are changed as described in Table 7.

Preparation of Composite Resin Particle Dispersions (M22) to (M27)

Composite resin particle dispersions (M22) to (M27) are prepared as with the preparation of the composite resin particle dispersion (M1) except that the amounts of 2-ethylhexyl acrylate and n-butyl acrylate used are adjusted.

In Table 7, the monomers are abbreviated as follows.

Styrene: St, n-butyl acrylate: BA, 2-ethylhexyl acrylate: 2EHA, ethyl acrylate: EA, 4-hydroxybutyl acrylate: 4HBA, acrylic acid: AA, methacrylic acid: MAA, 2-carboxyethyl acrylate: CEA, hexyl acrylate: HA, propyl acrylate: PA

TABLE 7

| Composite resin particle dispersion | | | | | | | | | |
|---|---|---|---|---|---|---|---|---|---|
| | | | | | Composite resin particles (or comparative resin particles) | | | | |
| | St resin | | | | | D50v | | | |
| | St resin particle | Polymerization | Tg | Ac resin Polymerization | Mass ratio of St resin to Ac resin (St:Ac) | of resin particles | Mw (k) | Tg | |
| No. | dispersion | components | ° C. | components | | nm | — | ° C. | ° C. |
| cM1 | St1 | St/BA/AA = 78/20/2 | 54 | 2EHA = 100 | 50:50 | 222 | 230 | −50 | 54 |
| cM2 | St1 | St/BA/AA = 78/20/2 | 54 | BA = 100 | 50:50 | 225 | 220 | −53 | 54 |
| cM3 | St12 | St/2 EHA/AA = 78/20/2 | 56 | BA = 100 | 50:50 | 224 | 212 | −53 | 56 |
| M1 | St1 | St/BA/AA = 78/20/2 | 54 | 2EHA/BA = 50/50 | 50:50 | 219 | 219 | −52 | 54 |
| M2 | St2 | St/BA/AA = 88/10/2 | 76 | 2EHA/BA = 50/50 | 50:50 | 218 | 240 | −52 | 76 |
| M3 | St3 | St/BA/AA = 83/15/2 | 65 | 2EHA/BA = 50/50 | 50:50 | 220 | 231 | −52 | 65 |
| M4 | St4 | St/BA/MAA = 78/20/2 | 57 | 2EHA/BA = 50/50 | 50:50 | 221 | 250 | −52 | 57 |
| M5 | St5 | St/BA/4HBA = 80/15/5 | 55 | 2EHA/BA = 50/50 | 50:50 | 224 | 242 | −52 | 55 |
| M6 | St6 | St/BA/2EHA = 80/15/5 | 54 | 2EHA/BA = 50/50 | 50:50 | 225 | 233 | −52 | 54 |
| M7 | St7 | St/BA = 80/20 | 54 | 2EHA/BA = 50/50 | 50:50 | 224 | 243 | −52 | 54 |
| M8 | St8 | St/BA/CEA = 77/20/3 | 54 | 2EHA/BA = 50/50 | 50:50 | 222 | 260 | −52 | 54 |
| M9 | St9 | St/BA/AA = 72/26/2 | 43 | 2EHA/BA = 50/50 | 50:50 | 223 | 251 | −52 | 43 |
| M10 | St10 | St/BA/AA = 68/30/2 | 35 | 2EHA/BA = 50/50 | 50:50 | 220 | 243 | −52 | 35 |
| M11 | St11 | St/2EHA = 80/20 | 56 | 2EHA/BA = 50/50 | 50:50 | 221 | 249 | −52 | 56 |
| M12 | St12 | St/2EHA/AA = 78/20/2 | 56 | 2EHA/BA = 50/50 | 50:50 | 227 | 237 | −52 | 56 |
| M13 | St12 | St/2EHA/AA = 78/20/2 | 56 | 2EHA/HA = 50/50 | 50:50 | 224 | 226 | −55 | 56 |
| M14 | St13 | St/EA/AA = 63/35/2 | 54 | 2EHA/PA = 50/50 | 50:50 | 224 | 243 | −45 | 54 |
| M15 | St1 | St/BA/AA = 78/20/2 | 54 | 2EHA/HA = 50/50 | 50:50 | 226 | 270 | −54 | 54 |
| M16 | St1 | St/BA/AA = 78/20/2 | 54 | 2EHA/BA = 90/10 | 50:50 | 224 | 264 | −51 | 54 |
| M17 | St1 | St/BA/AA = 78/20/2 | 54 | 2EHA/BA = 80/20 | 50:50 | 226 | 248 | −52 | 54 |
| M18 | St1 | St/BA/AA = 78/20/2 | 54 | 2EHA/BA = 70/30 | 50:50 | 226 | 260 | −52 | 54 |
| M19 | St1 | St/BA/AA = 78/20/2 | 54 | 2EHA/BA = 30/70 | 50:50 | 225 | 273 | −52 | 54 |
| M20 | St1 | St/BA/AA = 78/20/2 | 54 | 2EHA/BA = 20/80 | 50:50 | 224 | 233 | −52 | 54 |
| M21 | St1 | St/BA/AA = 78/20/2 | 54 | 2EHA/BA = 10/90 | 50:50 | 223 | 243 | −53 | 54 |
| M22 | St1 | St/BA/AA = 78/20/2 | 54 | 2EHA/BA = 50/50 | 90:10 | 182 | 180 | −52 | 54 |
| M23 | St1 | St/BA/AA = 78/20/2 | 54 | 2EHA/BA = 50/50 | 80:20 | 190 | 210 | −52 | 54 |
| M24 | St1 | St/BA/AA = 78/20/2 | 54 | 2EHA/BA = 50/50 | 70:30 | 199 | 223 | −52 | 54 |
| M25 | St1 | St/BA/AA = 78/20/2 | 54 | 2EHA/BA = 50/50 | 30:70 | 259 | 300 | −52 | 54 |
| M26 | St1 | St/BA/AA = 78/20/2 | 54 | 2EHA/BA = 50/50 | 20:80 | 300 | 320 | −52 | 54 |
| M27 | St1 | St/BA/AA = 78/20/2 | 54 | 2EHA/BA = 50/50 | 10:90 | 380 | 331 | −52 | 54 |

Preparation of Toner

Preparation of Toner (1) and Developer (1)

Composite resin particle dispersion (M1): 504 parts

Ion exchange water: 710 parts

Anionic surfactant (DOWFAX 2A1 produced by The Dow Chemical Company): 1 part

The above-described materials are placed in a reactor equipped with a thermometer and a pH meter, and the pH is adjusted to 3.0 by adding a 1.0% aqueous nitric acid solution at a temperature of 25° C. Then, while the resulting mixture is dispersed in a homogenizer (ULTRA-TURRAX T50 produced by IKA Japan) at a number of rotation of 5000 rpm, 23 parts of a 2.0% aqueous aluminum sulfate solution is added. Subsequently, a stirrer and a heating mantle are attached to the reactor. The temperature is elevated at a temperature elevation rate of 0.2° C./minute up to a temperature of 40° C. and then at 0.05° C./minute beyond 40° C. The particle diameter is measured every 10 minutes with Multisizer II (aperture diameter: 50 μm, produced by Beckman Coulter Inc.). The temperature is held when the volume-average particle diameter reached 5.0 μm, and 170 parts of the styrene resin particle dispersion (St1) is added thereto for 5 minutes. After completion of addition, a temperature of 50° C. is held for 30 minutes, a 1.0% aqueous sodium hydroxide solution is added thereto, and the pH of the slurry is adjusted to 6.0. Subsequently, while the pH is adjusted to 6.0 every 5° C., the temperature is elevated at a temperature elevation rate of 1° C./minute up to 90° C., and the temperature is retained at 90° C. The particle shape and the surface property are observed with an optical microscope and a field emission-type scanning electron microscope (FE-SEM), and coalescence of particles is confirmed at the 10th hour. The reactor is then cooled with cooling water for 5 minutes to 30° C.

The cooled slurry is passed through a nylon mesh having an aperture of 15 μm to remove coarse particles, and the slurry that has passed through the mesh is filtered at a reduced pressure by using an aspirator. The solid matter remaining on the paper filter is manually pulverized as finely as possible and is added to ion exchange water (temperature: 30° C.) in an amount ten times the amount of the solid matter. The resulting mixture is stirred for 30 minutes.

Subsequently, the solid matter remaining on the paper filter after filtration at a reduced pressure in an aspirator is pulverized manually as finely as possible and is added to ion exchange water (temperature: 30° C.) in an amount ten times the amount of the solid matter. The resulting mixture is stirred for 30 minutes and is again filtered at a reduced pressure with an aspirator. The electrical conductivity of the filtrate is measured. This operation is repeated until the electrical conductivity of the filtrate is 10 μS/cm or less so as to wash the solid matter.

The washed solid matter is finely pulverized in a wet-dry-type particle sizer (Comil) and then vacuum-dried in an oven at 25° C. for 36 hours. As a result, toner particles (1) are obtained. The volume average particle diameter of the toner particles (1) is 8.0 μm.

One hundred parts of the toner particles (1) and 1.5 parts of hydrophobic silica (RY50 produced by Nippon Aerosil Co., Ltd.) are mixed in a sample mill at a number of rotation of 13000 rpm for 30 seconds. The mixture is then screened through a vibrating screen having an aperture of 45 μm. As a result, a toner (1) is obtained.

Using the toner (1) as a sample, the thermal behavior in the temperature range of −150° C. to 100° C. is analyzed with a differential scanning calorimeter (DSC-60A produced by Shimadzu Corporation). Two glass transition temperatures are observed. Table 8 indicates the glass transition temperatures.

The temperature T1 and the temperature T2 of the toner (1) are measured with the aforementioned measuring method, and the toner (1) satisfies formula 3, "10° C. T1−T2".

A section of the toner (1) is observed with a scanning electron microscope (SEM). A sea-island structure is observed. The toner (1) has a core in which island phases are present, and a shell layer in which no island phases are present. The sea phase contains a styrene resin, and the island phases contain a (meth)acrylic acid ester resin. The average size of the island phases is determined by the aforementioned measuring method. The average size of the island phases is indicated in Table 8.

Into a V-type blender, 10 parts of the toner (1 and 100 parts of the following resin-coated carrier are placed, and the resulting mixture is stirred for 20 minutes. Then the mixture is screened through a vibrating screen having an aperture of 212 μm to obtain a developer (1).

Mn-Mg-Sr-based ferrite particles (average particle diameter: 40 μm: 100 parts

Toluene: 14 parts

Polymethyl methacrylate: 2 parts

Carbon black (VXC72 produced by Cabot Corporation): 0.12 parts

The above-described materials other than the ferrite particles and glass beads (diameter: 1 mm, in an amount equal to the amount of toluene) are mixed, and the resulting mixture is stirred in a sand mill produced by KANSAI PAINT CO., LTD., at a rotation rate of 1200 rpm for 30 minutes. As a result, a dispersion is obtained. The dispersion and the ferrite particles are placed in a vacuum deaerator-type kneader, and the resulting mixture is dried at a reduced pressure under stirring to obtain a resin-coated carrier.

Preparation of toners (2) to (27) and developers (2) to (27)

Toners (2) to (27) and developers (2) to (27) are prepared as with the preparation of the toner (1) except that the composite resin particle dispersion and the styrene resin particle dispersion are changed as indicated in Table 8.

The temperature T1 and the temperature T2 of the toners (2) to (27) are measured by the aforementioned measuring method, and the toners (2) to (27) all satisfy formula 3, "10° C. T1−T2".

Preparation of Comparative Toners (c1) to (c3) and Developers (c1) to (c3)

Toners (c1) to (c3) and developers (c1) to (c3) are prepared as with the preparation of the toner (1) except that the composite resin particle dispersion and the styrene resin particle dispersion are changed as indicated in Table 8.

Evaluation of Pressure-Responsive Phase Transition

The temperature difference (T1−T3), which is the indicator of how easily the toner undergoes pressure-induced phase transition, is determined. For each toner sample, the temperature T1 and the temperature T3 are measured with a Flowtester (CFT-500 produced by Shimadzu Corporation), and the temperature difference (T1−T3) is calculated. Table 8 indicates the temperature difference (T1−T3).

Evaluation of Bondability

An apparatus of a type illustrated in FIG. 2 is prepared as the apparatus for producing a printed material. In other words, an apparatus for producing a printed material, the apparatus equipped with a five-stand-tandem intermediate transfer-type printing unit that performs placement of the transparent toner and formation of color images onto a recording medium, and a press bonding unit that has a folding device and a pressurizing device is prepared.

A transparent toner, a yellow toner, a magenta toner, a cyan toner, and a black toner are respectively placed in five developing devices in the printing unit. Commercially available products produced by Fuji Xerox Co., Ltd., are used as the yellow toner, the magenta toner, the cyan toner, and the black toner.

Postcard paper V424 produced by Fuji Xerox Co., Ltd., is prepared as the recording medium.

The image to be formed on the postcard paper is an image having an area density of 30% in which black characters and a full-color photographic image are both contained. The image is formed on one surface of the postcard paper.

The amount of the transparent toner applied is 3 g/m$^2$ in an image-forming region of an image-forming surface of the postcard paper.

The folding device is a device that folds the postcard paper in two such that the surface on which the image is formed is arranged on the inner side.

The pressurizing device is to apply a pressure of 90 MPa.

Ten postcards are continuously formed by using the above-described apparatus under the above-described conditions by folding a postcard paper in two with the image-formed surface facing inward and then bonding the image-formed surfaces of the flaps of the postcard paper.

The tenth postcard is cut in the long side direction at a width of 15 mm to prepare a rectangular test piece, and the test piece is subjected to the 90 degrees peel test. The peeling speed of the 90 degrees peel test is set to 20 mm/minute, the load (N) from 10 mm to 50 mm is sampled at 0.4 mm intervals after start of the measurement, the average of the results is calculated, and the loads (N) observed from three test pieces are averaged. The load (N) required for peeling is categorized as follows. The results are indicated in Table 8.

A: 0.8 N or more

B: 0.6 N or more but less than 0.8 N

C: 0.4 N or more but less than 0.6 N

D: 0.2 N or more but less than 0.4 N

E: less than 0.2 N

TABLE 8

| | Core | | | | | Toner | | | | | | | |
|---|---|---|---|---|---|---|---|---|---|---|---|---|---|
| Toner | Composite resin particle dispersion | Polymerization components of St resin | Polymerization components of Ac resin | Mass ratio of St resin to Ac resin (St:Ac) | Shell layer St resin particle dispersion | D50 v μm | Average size of island phases nm | Tg ° C. | Tg ° C. | Difference in Tg ° C. | T3 ° C. | Pressure-responsive phase transition (T1-T3) ° C. | Bondability |
| c1 | cM1 | St/BA/AA = 78/20/2 | 2EHA = 100 | 50:50 | St1 | 8.0 | 600 | −50 | 54 | 104 | 95 | 3 | D |
| c2 | cM2 | St/BA/AA = 78/20/2 | BA = 100 | 50:50 | St1 | 8.0 | 550 | −53 | 54 | 107 | 93 | 4 | D |
| c3 | cM3 | St/2EHA/AA = 78/20/2 | BA = 100 | 50:50 | St12 | 11.0 | 570 | −53 | 56 | 109 | 93 | 4 | D |
| 1 | M1 | St/BA/AA = 78/20/2 | 2EHA/BA = 50/50 | 50:50 | St1 | 8.0 | 200 | −52 | 54 | 106 | 75 | 15 | A |
| 2 | M2 | St/BA/AA = 88/10/2 | 2EHA/BA = 50/50 | 50:50 | St2 | 11.0 | 250 | −52 | 76 | 128 | 70 | 13 | A |
| 3 | M3 | St/BA/AA = 83/15/2 | 2EHA/BA = 50/50 | 50:50 | St3 | 11.0 | 280 | −52 | 65 | 117 | 78 | 15 | A |
| 4 | M4 | St/BA/MAA = 78/20/2 | 2EHA/BA = 50/50 | 50:50 | St4 | 11.0 | 240 | −52 | 57 | 109 | 70 | 10 | A |
| 5 | M5 | St/BA/4HBA = 80/15/5 | 2EHA/BA = 50/50 | 50:50 | St5 | 11.0 | 240 | −52 | 55 | 107 | 74 | 16 | A |
| 6 | M6 | St/BA/2EHA = 80/15/5 | 2EHA/BA = 50/50 | 50:50 | St6 | 11.0 | 250 | −52 | 54 | 106 | 73 | 14 | A |
| 7 | M7 | St/BA = 80/20 | 2EHA/BA = 50/50 | 50:50 | St7 | 9.5 | 250 | −52 | 54 | 106 | 73 | 13 | A |
| 8 | M8 | St/BA/CEA = 77/20/3 | 2EHA/BA = 50/50 | 50:50 | St8 | 9.5 | 250 | −52 | 54 | 106 | 75 | 10 | A |
| 9 | M9 | St/BA/AA = 72/26/2 | 2EHA/BA = 50/50 | 50:50 | St9 | 9.5 | 220 | −52 | 43 | 95 | 75 | 15 | A |
| 10 | M10 | St/BA/AA = 68/30/2 | 2EHA/BA = 50/50 | 50:50 | St10 | 9.5 | 230 | −52 | 35 | 87 | 73 | 15 | A |
| 11 | M11 | St/2HA = 80/20 | 2EHA/BA = 50/50 | 50:50 | St11 | 9.5 | 220 | −52 | 56 | 108 | 72 | 15 | A |
| 12 | M12 | St/2EHA/AA = 78/20/2 | 2EHA/BA = 50/50 | 50:50 | St12 | 9.5 | 230 | −52 | 56 | 108 | 75 | 20 | A |
| 13 | M13 | St/2EHA/AA = 78/20/2 | 2EHA/HA = 50/50 | 50:50 | St12 | 5.8 | 250 | −55 | 56 | 111 | 70 | 15 | A |
| 14 | M14 | St/EA/AA = 63/35/2 | 2EHA/PA = 50/50 | 50:50 | St13 | 5.8 | 350 | −45 | 54 | 99 | 80 | 5 | B |
| 15 | M15 | St/BA/AA = 78/20/2 | 2EHA/HA = 50/50 | 50:50 | St1 | 5.8 | 400 | −54 | 54 | 108 | 81 | 7 | B |
| 16 | M16 | St/BA/AA = 78/20/2 | 2EHA/BA = 90/10 | 50:50 | St1 | 8.0 | 400 | −51 | 54 | 105 | 80 | 10 | B |
| 17 | M17 | St/BA/AA = 78/20/2 | 2EHA/BA = 80/20 | 50:50 | St1 | 8.0 | 300 | −52 | 54 | 106 | 70 | 20 | A |
| 18 | M18 | St/BA/AA = 78/20/2 | 2EHA/BA = 70/30 | 50:50 | St1 | 8.0 | 250 | −52 | 54 | 106 | 75 | 15 | A |
| 19 | M19 | St/BA/AA = 78/20/2 | 2EHA/BA = 30/70 | 50:50 | St1 | 8.0 | 250 | −52 | 54 | 106 | 73 | 15 | A |
| 20 | M20 | St/BA/AA = 78/20/2 | 2EHA/BA = 20/80 | 50:50 | St1 | 8.0 | 300 | −52 | 54 | 106 | 75 | 20 | A |
| 21 | M21 | St/BA/AA = 78/20/2 | 2EHA/BA = 10/90 | 50:50 | St1 | 8.0 | 400 | −53 | 54 | 107 | 80 | 9 | B |
| 22 | M22 | St/BA/AA = 78/20/2 | 2EHA/BA = 50/50 | 90:10 | St1 | 8.0 | 450 | −52 | 54 | 106 | 85 | 5 | C |
| 23 | M23 | St/BA/AA = 78/20/2 | 2EHA/BA = 50/50 | 80:20 | St1 | 8.0 | 400 | −52 | 54 | 106 | 80 | 10 | B |
| 24 | M24 | St/BA/AA = 78/20/2 | 2EHA/BA = 50/50 | 70:30 | St1 | 8.0 | 250 | −52 | 54 | 106 | 75 | 15 | A |
| 25 | M25 | St/BA/AA = 78/20/2 | 2EHA/BA = 50/50 | 30:70 | St1 | 8.0 | 210 | −52 | 54 | 106 | 73 | 13 | A |
| 26 | M26 | St/BA/AA = 78/20/2 | 2EHA/BA = 50/50 | 20:80 | St1 | 8.0 | 230 | −52 | 54 | 106 | 72 | 13 | A |
| 27 | M27 | St/BA/AA = 78/20/2 | 2EHA/BA = 50/50 | 10:90 | St1 | 8.0 | 250 | −52 | 54 | 106 | 72 | 13 | A |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner set comprising:

a color toner; and a transparent toner that has a pressure phase transition property, wherein the color toner and the transparent toner satisfy the following formulae:

$$1.0 \leq \tan \delta 1 \leq 4.0$$

$$1.2 \leq \tan \delta 1 / \tan \delta 2 \leq 3.0$$

where tan δ1 represents a dynamic viscoelasticity tan δ measured by a sine wave oscillation method of the color toner at 100° C., and tan δ2 represents the dynamic viscoelasticity tan δ measured by the sine wave oscillation method of the transparent toner at 100° C.

2. The toner set according to claim 1, wherein tan δ1 is in a range of 1.5 to 3.5.

3. The toner set according to claim 1, wherein tan δ1 and tan δ2 satisfy the following formula:

$$1.5 \leq \tan \delta 1 / \tan \delta 2 \leq 2.9.$$

4. The toner set according to claim 1, wherein the color toner contains a polyester resin, and the transparent toner contains a vinyl-based resin.

5. The toner set according to claim 1, wherein the transparent toner has two glass transition temperatures, and a difference between the lowest glass transition temperature and the highest glass transition temperature is 30° C. or more.

6. The toner set according to claim 1, wherein the transparent toner contains:

a styrene resin containing styrene monomer unit, and a (meth)acrylic acid ester resin, and the (meth)acrylic acid ester resin contains two (meth) acrylic acid ester monomer units, and a mass ratio of the (meth)acrylic acid esters relative to a total of monomer units of the (meth)acrylic acid ester resin is 90 mass % or more.

7. The toner set according to claim 6, wherein a mass ratio of the styrene monomer unit relative to a total of monomer units of the styrene resin is 60 mass % or more and 95 mass % or less.

8. The toner set according to claim 6, wherein a mass ratio between the two (meth)acrylic acid ester monomer units in the (meth)acrylic acid ester resin is in a range of 80:20 to 20:80.

9. The toner set according to claim 6, wherein a difference in the number of carbon atoms in an alkyl group between the two (meth)acrylic acid ester monomer units in the (meth) acrylic acid ester resin is in a range of 1 to 4.

10. The toner set according to claim 6, wherein the styrene resin further contains a (meth)acrylic acid ester monomer unit.

11. The toner set according to claim 10, wherein the (meth)acrylic acid ester monomer unit contained in the styrene resin is selected from n-butyl acrylate and 2-ethylhexyl acrylate.

12. The toner set according to claim 10, wherein the styrene resin and the (meth)acrylic acid ester resin contain the same (meth)acrylic acid ester monomer unit.

13. The toner set according to claim 6, wherein the (meth)acrylic acid ester resin contains 2-ethylhexyl acrylate and n-butyl acrylate as monomer units.

14. The toner set according to claim 6, wherein an amount of the styrene resin is larger than an amount of the (meth) acrylic acid ester resin.

15. The toner set according to claim 6, wherein the transparent toner contains a sea phase that contains the styrene resin, and island phases that contain the (meth) acrylic acid ester resin.

16. The toner set according to claim 15, wherein the island phases have an average size in a range of 200 nm to 500 nm.

17. The toner set according to claim 6, wherein the transparent toner has:

a core containing the styrene resin and the (meth)acrylic acid ester resin, and a shell layer covering the core.

18. The toner set according to claim 17, wherein the shell layer contains the styrene resin.

19. A toner cartridge set detachably attachable to an apparatus for forming a printed material, the toner cartridge set comprising:

a first toner cartridge containing the color toner in the toner set according to claim 1, and a second toner cartridge containing the transparent toner in the toner set according to claim 1.

20. An apparatus for forming a printed material, the apparatus comprising:

a color toner image forming unit that contains a first electrostatic charge image developer containing the color toner in the toner set according to claim 1 and that electrophotographically forms a color toner image on a recording medium by using the first electrostatic charge image developer;

a transparent toner image forming unit that contains a second electrostatic charge image developer containing the transparent toner in the toner set according to claim 1 and that electrophotographically forms a transparent toner layer on the recording medium by using the transparent toner;

a thermal fixing unit that thermally fixes the color toner image onto the recording medium, and a press bonding unit that folds and press-bonds the recording medium having the color toner image thermally fixed thereon, or that superimposes another recording medium on the recording medium having the color toner image thermally fixed thereon and press-bonds the recording media.

21. The toner set according to claim 1, wherein the transparent toner satisfies formula (3) below:

$$10^\circ\ \text{C.} \leq T1 - T2 \leq 120^\circ\ \text{C.} \quad (3),$$

wherein, in formula (3), T1 represents a temperature at which the viscosity is 10000 Pa·s at a pressure of 1 MPa, and T2 represents a temperature at which the viscosity is 10000 Pa·s at a pressure of 10 MPa.

22. The toner set according to claim 1, wherein the transparent toner satisfies formula (4) below:

$$5^\circ\ \text{C.} \leq T1 - T3 \leq 25^\circ\ \text{C.} \quad (4),$$

wherein, in formula (4), T1 represents a temperature at which the viscosity is 10000 Pa·s at a pressure of 1 MPa, and T3 represents a temperature at which the viscosity is 10000 Pa·s at a pressure of 4 MPa.

* * * * *